US011288997B1

(12) United States Patent
Im et al.

(10) Patent No.: US 11,288,997 B1
(45) Date of Patent: Mar. 29, 2022

(54) DISPLAY DEVICE, AND METHOD OF OPERATING THE DISPLAY DEVICE

(71) Applicant: Samsung Display Co., Ltd., Yongin-Si (KR)

(72) Inventors: Taegon Im, Seongnam-si (KR); Gwangsoo Ahn, Suwon-si (KR); Jong Jae Lee, Hwaseong-si (KR); Byungkil Jeon, Hwaseong-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 17/354,695

(22) Filed: Jun. 22, 2021

(30) Foreign Application Priority Data

Nov. 11, 2020 (KR) ..... 10-2020-0150015

(51) Int. Cl.
*G09G 3/20* (2006.01)

(52) U.S. Cl.
CPC ..... *G09G 3/20* (2013.01); *G09G 2300/0413* (2013.01); *G09G 2330/021* (2013.01); *G09G 2330/028* (2013.01)

(58) Field of Classification Search
CPC ..... G09G 3/20; G09G 2300/0413; G09G 2330/021; G09G 2330/028
See application file for complete search history.

(56) References Cited

U.S. PATENT DOCUMENTS

2020/0184900 A1* 6/2020 Shin ..... G09G 3/2003
2020/0184908 A1* 6/2020 Nishiguchi ..... G09G 3/342

FOREIGN PATENT DOCUMENTS

KR 10-1696458 B1 1/2017
KR 10-2019-0085209 A 7/2019

* cited by examiner

*Primary Examiner* — Sejoon Ahn
(74) *Attorney, Agent, or Firm* — Innovation Counsel LLP

(57) ABSTRACT

A display device includes a display panel including a plurality of data lines, and a plurality of pixels coupled to the plurality of data lines, a data driver including a plurality of channels providing data voltages to the plurality of pixels through the plurality of data lines, and a controller configured to control the data driver. The plurality of channels is grouped into first through N-th channel groups, where N is an integer greater than 1. The first through N-th channel groups sequentially initiate first dummy data voltage output operations in a first order from the first channel group to the N-th channel group in a first blank period before an active period, and sequentially finish second dummy data voltage output operations in a second order from the N-th channel group to the first channel group in a second blank period after the active period.

20 Claims, 13 Drawing Sheets

DISPLAY DEVICE, AND METHOD OF OPERATING THE DISPLAY DEVICE

CROSS-REFERENCE TO RELATED APPLICATION(S)

This application claims priority under 35 USC § 119 to Korean Patent Application No. 10-2020-0150015, filed on Nov. 11, 2020, in the Korean Intellectual Property Office (KIPO), the content of which is incorporated by reference herein in its entirety.

BACKGROUND

1. Field

Embodiments of the present inventive concept relate to display devices, and more particularly to display devices performing a dummy data voltage output operation, and methods of operating the display devices.

2. Description of the Related Art

Generally, a display device may include a display panel including a plurality of pixels, a data driver providing data voltages to the plurality of pixels through data lines, a scan driver providing scan signals to the plurality of pixels through scan lines, and a controller controlling the data driver and the scan driver.

A frame period of the display device may include an active period and a blank period (or a vertical blank period). In the active period, the data driver may output the data voltages to the data lines, and the plurality of pixels may display an image based on the data voltages received through the data lines. In the blank period, the data driver may not output the data voltages to the data lines, or may output a black data voltage to the data lines.

However, a current, e.g., a current flowing through an analog power supply voltage line, in the display device may be drastically changed (increased or decreased) between the blank period in which the data voltages are not output and the active period in which the data voltages are output. Due to the drastic change of the current, components, e.g., a capacitor, an inductor, a board, etc., of the display device may vibrate, and a sound noise may occur in the display device by the vibration of the components.

SUMMARY

Some embodiments provide a display device capable of preventing a sound noise from occurring.

Some embodiments provide a method of operating a display device capable of preventing a sound noise from occurring.

According to embodiments, there is provided a display device including a display panel including a plurality of data lines, and a plurality of pixels coupled to the plurality of data lines, a data driver including a plurality of channels providing data voltages to the plurality of pixels through the plurality of data lines, and a controller configured to control the data driver. The plurality of channels is grouped into first through N-th channel groups, where N is an integer greater than 1. The first through N-th channel groups sequentially initiate first dummy data voltage output operations in a first order from the first channel group to the N-th channel group in a first blank period before an active period, and sequentially finish second dummy data voltage output operations in a second order from the N-th channel group to the first channel group in a second blank period after the active period.

In embodiments, the first through N-th channel groups may substantially simultaneously finish the first dummy data voltage output operations at an end time point of the first blank period, and may substantially simultaneously initiate the second dummy data voltage output operations at a start time point of the second blank period.

In embodiments, the display panel may further include dummy pixels disposed in a first dummy region located at a first side of a display region in which the plurality of pixels is disposed. The first blank period may include a first dummy region period in which dummy data voltages are output to the dummy pixels disposed in the first dummy region. The first through N-th channel groups may sequentially initiate the first dummy data voltage output operations in the first order in the first dummy region period.

In embodiments, the first dummy region period may be divided into first through N-th sub-periods. The first through N-th channel groups may initiate the first dummy data voltage output operations at start time points of the first through N-th sub-periods, respectively.

In embodiments, the first dummy data voltage output operations may alternately output maximum data voltages and black data voltages as the dummy data voltages to the dummy pixels.

In embodiments, the first dummy data voltage output operations may alternately output gradually increasing data voltages and black data voltages as the dummy data voltages to the dummy pixels.

In embodiments, the display panel may further include dummy pixels disposed in a second dummy region located at a second side of a display region in which the plurality of pixels is disposed. The second blank period may include a second dummy region period in which dummy data voltages are output to the dummy pixels disposed in the second dummy region. The first through N-th channel groups may sequentially finish the second dummy data voltage output operations in the second order in the second dummy region period.

In embodiments, the second dummy region period may be divided into first through N-th sub-periods. The first through N-th channel groups may finish the second dummy data voltage output operations at end time points of the first through N-th sub-periods, respectively.

In embodiments, the second dummy data voltage output operations may alternately output maximum data voltages and black data voltages as the dummy data voltages to the dummy pixels.

In embodiments, the second dummy data voltage output operations may alternately output gradually decreasing data voltages and black data voltages as the dummy data voltages to the dummy pixels.

In embodiments, the controller may provide line data for each pixel row to the data driver. The line data may include line start data representing a start of the line data, configuration data representing configuration information, pixel data for the plurality of pixels included in the each pixel row, and horizontal blank period data corresponding to a horizontal blank period. The first dummy data voltage output operations of the first through N-th channel groups in the first blank period may be controlled by the pixel data of the line data in the first blank period, and the second dummy data voltage output operations of the first through N-th channel groups in the second blank period may be controlled by the pixel data of the line data in the second blank period.

In embodiments, the controller may provide line data for each pixel row to the data driver. The line data may include line start data representing a start of the line data, configuration data representing configuration information, pixel data for the plurality of pixels included in the each pixel row, and horizontal blank period data corresponding to a horizontal blank period. The first dummy data voltage output operations of the first through N-th channel groups in the first blank period may be controlled by the configuration data of the line data in the first blank period, and the second dummy data voltage output operations of the first through N-th channel groups in the second blank period may be controlled by the configuration data of the line data in the second blank period.

In embodiments, the data driver may include a counter that counts a clock signal to generate a counted clock signal. The first dummy data voltage output operations of the first through N-th channel groups in the first blank period and the second dummy data voltage output operations of the first through N-th channel groups in the second blank period may be controlled based on the counted clock signal.

According to embodiments, there is provided a method of operating a display device. In the method, a plurality of channels of a data driver of the display device is grouped into first through N-th channel groups, where N is an integer greater than 1. First dummy data voltage output operations of the first through N-th channel groups are sequentially initiated in a first order from the first channel group to the N-th channel group in a first blank period before an active period. Active data voltage output operations of the first through N-th channel groups are performed in the active period. Second dummy data voltage output operations of the first through N-th channel groups are sequentially finished in a second order from the N-th channel group to the first channel group in a second blank period after the active period.

In embodiments, the first dummy data voltage output operations of the first through N-th channel groups may be substantially simultaneously finished at an end time point of the first blank period. The second dummy data voltage output operations of the first through N-th channel groups may be substantially simultaneously initiated at a start time point of the second blank period.

In embodiments, a display panel of the display device may include a plurality of pixels disposed in a display region, and dummy pixels disposed in a first dummy region located at a first side of the display region. The first blank period may include a first dummy region period in which dummy data voltages are output to the dummy pixels disposed in the first dummy region. The first through N-th channel groups may sequentially initiate the first dummy data voltage output operations in the first order in the first dummy region period.

In embodiments, a display panel of the display device may include a plurality of pixels disposed in a display region, and dummy pixels disposed in a second dummy region located at a second side of the display region. The second blank period may include a second dummy region period in which dummy data voltages are output to the dummy pixels disposed in the second dummy region. The first through N-th channel groups may sequentially finish the second dummy data voltage output operations in the second order in the second dummy region period.

In embodiments, a controller of the display device may provide line data for each pixel row to the data driver. The line data may include configuration data representing configuration information, pixel data for the plurality of pixels included in the each pixel row, and horizontal blank period data corresponding to a horizontal blank period. The first dummy data voltage output operations of the first through N-th channel groups in the first blank period may be controlled by the pixel data of the line data in the first blank period. The second dummy data voltage output operations of the first through N-th channel groups in the second blank period may be controlled by the pixel data of the line data in the second blank period.

In embodiments, a controller of the display device may provide line data for each pixel row to the data driver. The line data may include line start data representing a start of the line data, configuration data representing configuration information, pixel data for the plurality of pixels included in the each pixel row, and horizontal blank period data corresponding to a horizontal blank period. The first dummy data voltage output operations of the first through N-th channel groups in the first blank period may be controlled by the configuration data of the line data in the first blank period. The second dummy data voltage output operations of the first through N-th channel groups in the second blank period may be controlled by the configuration data of the line data in the second blank period.

In embodiments, the data driver may include a counter that counts a clock signal to generate a counted clock signal. The first dummy data voltage output operations of the first through N-th channel groups in the first blank period and the second dummy data voltage output operations of the first through N-th channel groups in the second blank period may be controlled based on the counted clock signal.

As described above, in a display device and a method of operating the display device according to embodiments, a plurality of channels of a data driver may be grouped into first through N-th channel groups, where N is an integer greater than 1. First dummy data voltage output operations of the first through N-th channel groups may be sequentially initiated in a first order from the first channel group to the N-th channel group in a first blank period before an active period. Second dummy data voltage output operations of the first through N-th channel groups may be sequentially finished in a second order from the N-th channel group to the first channel group in a second blank period after the active period. Thus, a current in the display device may gradually increase in the first blank period before the active period, and may gradually decrease in the second blank period after the active period. Accordingly, a sound noise caused by a drastic change of the current may be prevented from occurring. Further, since the first through N-th channel groups may be sequentially driven in each blank period, power consumption may be reduced compared with a case where all of the plurality of channels is simultaneously driven.

BRIEF DESCRIPTION OF THE DRAWINGS

Illustrative, non-limiting embodiments will be more clearly understood from the following detailed description in conjunction with the accompanying drawings.

DETAILED DESCRIPTION OF THE EMBODIMENTS

Hereinafter, embodiments of the present inventive concept will be explained in detail with reference to the accompanying drawings.

Figure 1:
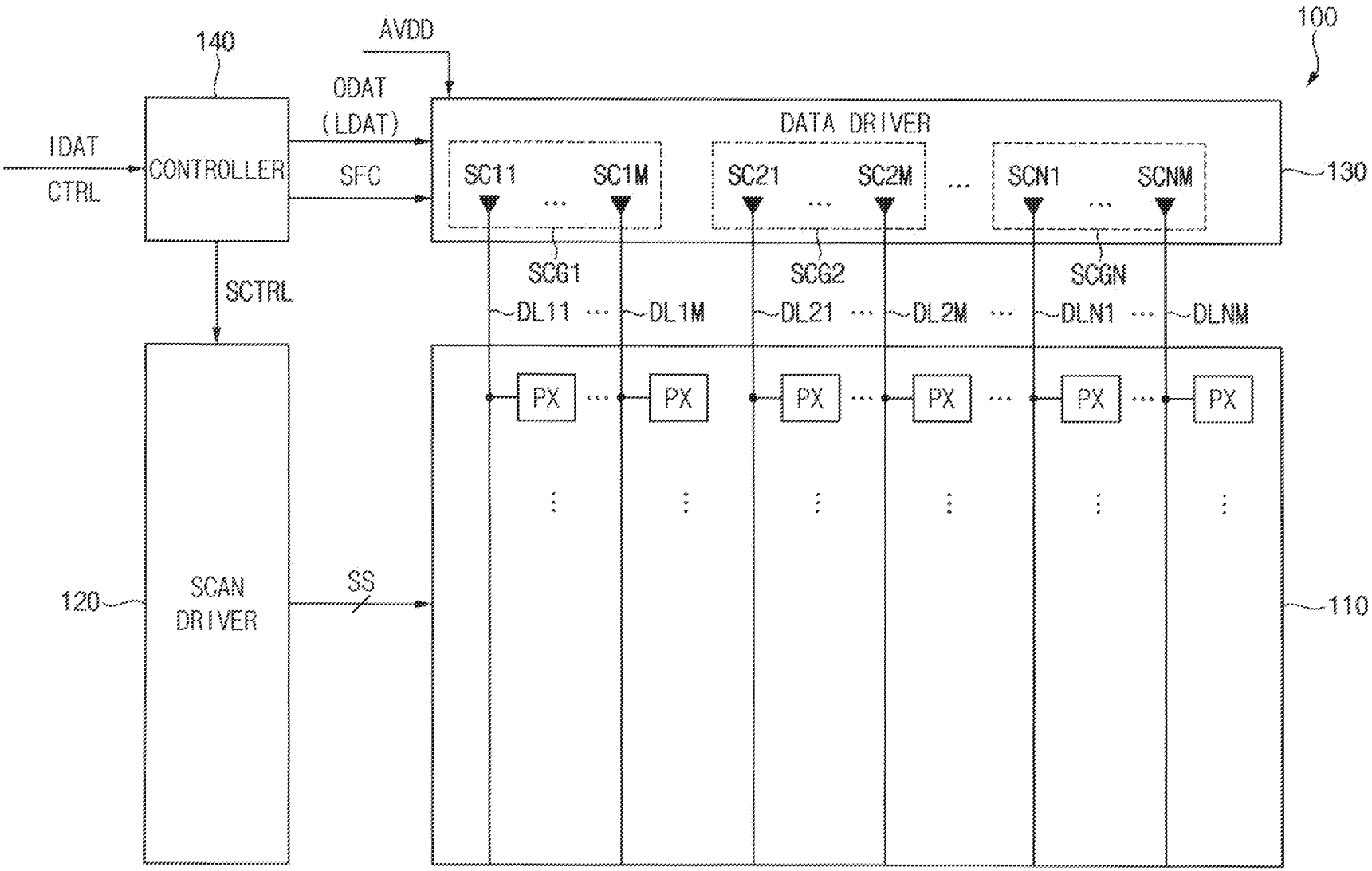
FIG. 1 is a block diagram illustrating a display device according to embodiments.
Figure 2:
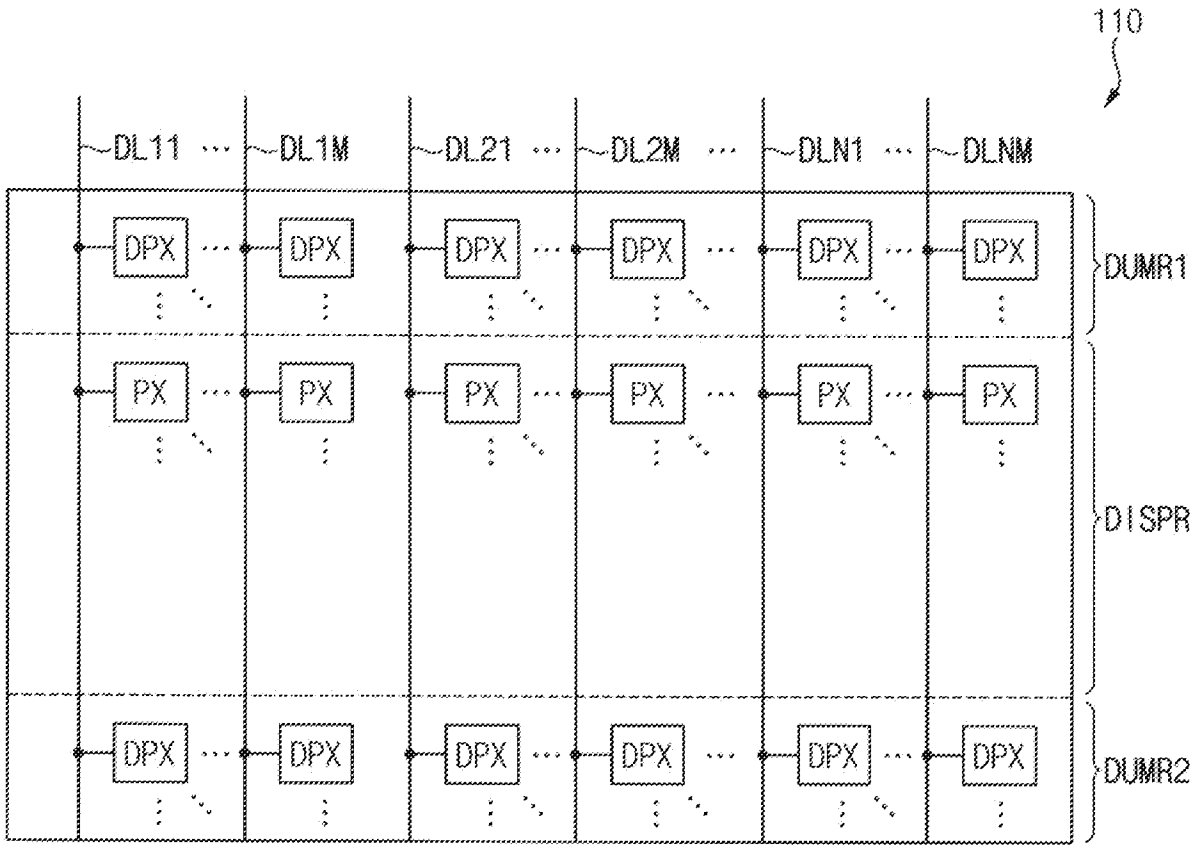
FIG. 2 is a block diagram illustrating an example of a display panel included in a display device according to embodiments.
Figure 3:
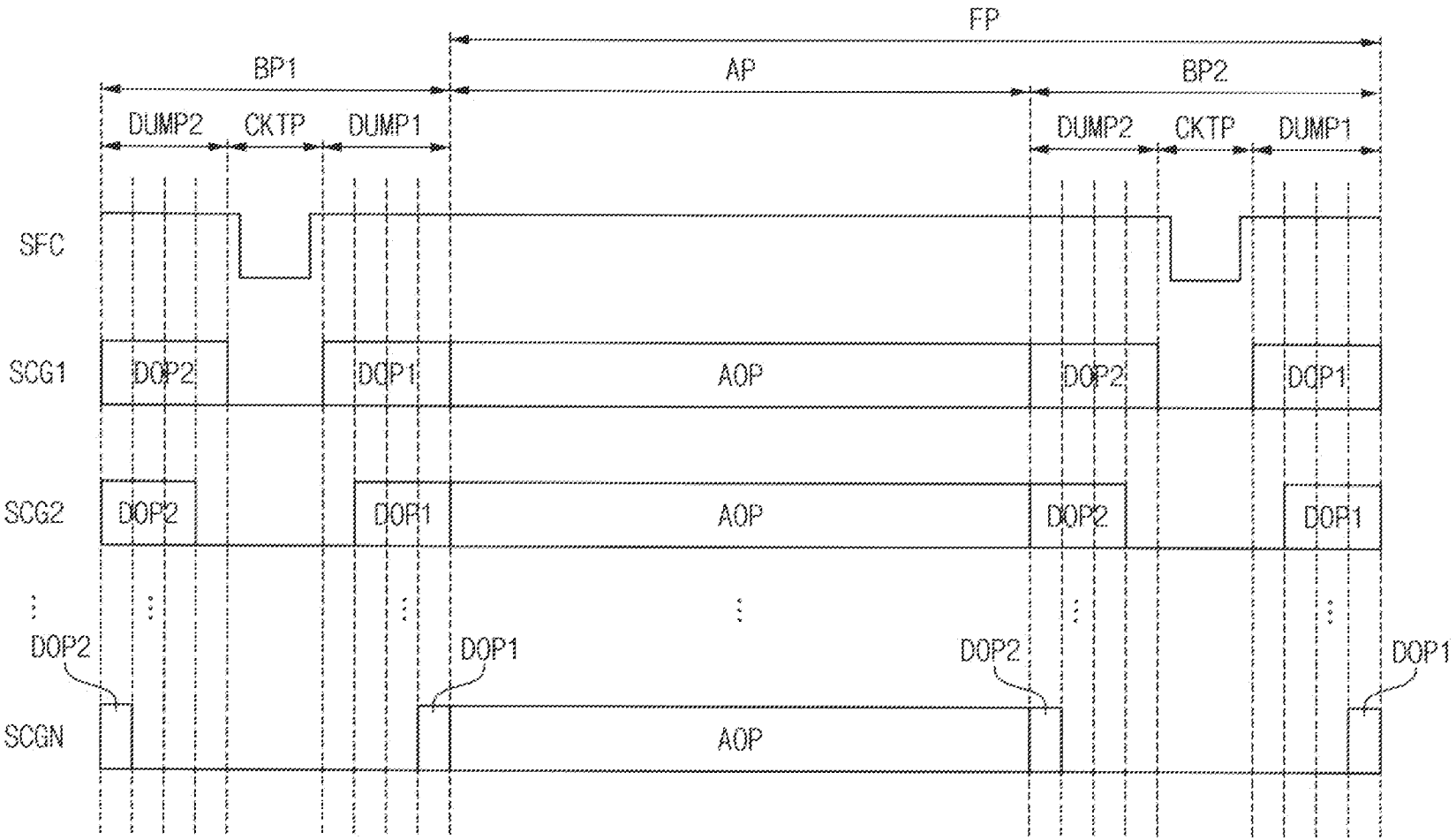
FIG. 3 is a timing diagram for describing examples of first and second dummy data voltage output operations of first through N-th channel groups of a data driver of a display device according to embodiments.

FIG. 1 is a block diagram illustrating a display device 100 according to embodiments. FIG. 2 is a block diagram illustrating an example of a display panel 110 included in the display device 100 according to embodiments. FIG. 3 is a timing diagram for describing examples of first and second dummy data voltage output operations of first through N-th channel groups of a data driver of the display device 100 according to embodiments.

Referring to FIG. 1, the display device 100 according to embodiments may include the display panel 110 including a plurality of pixels PX, a scan driver 120 that provides scan signals SS to the plurality of pixels PX, a data driver 130 that provides data voltages to the plurality of pixels PX, and a controller 140 that controls the scan driver 120 and the data driver 130.

The display panel 110 may include a plurality of data lines DL11, . . . , DL1M, DL21, . . . , DL2M, . . . , DLN1, . . . , and DLNM, a plurality of scan lines, and the plurality of pixels PX coupled to the data lines DL11, . . . , DL1M, DL21, . . . , DL2M, . . . , DLN1, . . . , and DLNM and the plurality of scan lines. In some embodiments, each pixel PX may include at least two transistors, at least one capacitor and an organic light emitting diode (OLED), and the display panel 110 may be an OLED display panel. In other embodiments, each pixel PX may include a switching transistor, and a liquid crystal capacitor coupled to the switching transistor, and the display panel 110 may be a liquid crystal display (LCD) panel. However, the display panel 110 may be any other suitable display panel.

In some embodiments, as illustrated in FIG. 2, the display panel 110 may further include dummy pixels DPX disposed in a first dummy region DUMR1 located at an upper, e.g., first, side of a display region DISPR in which the plurality of pixels PX is disposed, and dummy pixels DPX disposed in a second dummy region DUMR2 located at a lower, e.g., second, side of the display region DISPR. Although the terms "upper", "lower" and similar terms are used herein, it is to be understood that the terms are relative directions and do not necessarily have a gravitational reference. The display panel 110 may further include dummy scan lines disposed in the first dummy region DUMR1 and the second dummy region DUMR2, and the dummy pixels DPX in the first and second dummy regions DUMR1 and DUMR2 may be coupled to the plurality of data lines DL11, . . . , DL1M, DL21, . . . , DL2M, . . . , DLN1, . . . , and DLNM and the dummy scan lines. In some embodiments, each dummy pixel DPX may have a structure substantially the same as a structure of the pixel PX in the display region DISPR. However, a light blocking pattern (or a black mask) may be disposed on the dummy pixels DPX, and thus an image by the dummy pixels DPX may not be viewed by a user. Although FIG. 2 illustrates an example of the display panel 110 including the dummy pixels DPX in the first and second dummy regions DUMR1 and DUMR2, in an embodiment, the display panel 110 may include the dummy pixels DPX in only one of the first and second dummy regions DUMR1 and DUMR2, or may not include the dummy pixels DPX.

The scan driver 120 may generate the scan signals SS based on a scan control signal SCTRL received from the controller 140, and may provide the scan signals SS to the plurality of pixels PX and/or the dummy pixels DPX through the plurality of scan lines and/or the dummy scan lines. In some embodiments, the scan control signal SCTRL may include a scan start signal and a scan clock signal. In some embodiments, the scan driver 120 may be formed or integrated in a peripheral region of the display panel 110. In other embodiments, the scan driver 120 may be implemented with one or more scan integrated circuits (ICs). Further, according to some embodiments, the scan driver 120 may be mounted directly on the display panel 110 in a form of a chip on glass (COG) or a chip on plastic (COP), or may be coupled to the display panel 110 through a flexible film in a form of a chip on film (COF).

The data driver 130 may receive output image data ODAT including a plurality of line data LDAT for rows of the plurality of pixels PX and/or rows of the dummy pixels DPX from the controller 140, may generate the data voltages based on the output image data ODAT, and may provide the data voltages to the plurality of pixels PX through the plurality of data lines DL11, . . . , DL1M, DL21, . . . , DL2M, . . . , DLN1, . . . , and DLNM. The data driver 130 may receive an analog power supply voltage AVDD from the controller 140 or a power management circuit, e.g., a power management integrated circuit (PMIC). Analog components, e.g., output buffers, of the data driver 130 may operate based on the analog power supply voltage AVDD.

In some embodiments, a high speed interface for transferring the output image data ODAT, for example a unified standard interface for TV (a USI-T interface), may be used between the controller 140 and the data driver 130, and the output image data ODAT may be transferred from the controller 140 to the data driver 130 in a form of a clock-embedded data signal defined in a standard of the high speed interface. For example, the controller 140 may transfer clock training pattern data as the output image data ODAT to the data driver 130 in a blank period, and the data driver 130 may perform training on a clock signal in data driver 130 based on the clock training pattern data. Further, the controller 140 may inform the data driver 130 about the transfer of the clock training pattern data by using a shared forward channel SFC. In some embodiments, the data driver 130 may be implemented with a plurality of data driver ICs. Further, the shared forward channel SFC may be commonly coupled to the plurality of data driver ICs, and may be shared by the plurality of data driver ICs. According to embodiments, the plurality of data driver ICs may be mounted directly on the display panel 110 in the form of the COG or the COP, or may be coupled to the display panel 110 through a flexible film in the form of the COF. In other embodiments, the data driver 130 may be implemented with a single data driver IC, or the data driver 130 and the controller 140 may be implemented with a single IC.

In some embodiments, the data driver 130 may include a plurality of channels SC11, . . . , SC1M, SC21, . . . , SC2M, . . . , SCN1, . . . , and SCNM that provides the data voltages to the plurality of pixels PX and/or the dummy pixels DPX through the plurality of data lines DL11, . . . , DL1M, DL21, . . . , DL2M, . . . , DLN1, . . . , and DLNM. Here, each channel SC11, . . . , SC1M, SC21, . . . , SC2M, . . . , SCN1, . . . , and SCNM may mean one or more components of the data driver 130 for outputting one data voltage. For example, each channel SC11, . . . , SC1M, SC21, . . . , SC2M, . . . , SCN1, . . . , and SCNM may include the output buffer that outputs the data voltage. In some embodiments, each channel SC11, . . . , SC1M, SC21, . . . , SC2M, . . . , SCN1, . . . , and SCNM may further include a digital-to-analog converter, a latch, etc. In some embodiments, the plurality of channels SC11, . . . , SC1M, SC21, . . . , SC2M, . . . , SCN1, . . . , and SCNM may output the data voltages to the plurality of data lines DL11, . . . , DL1M, DL21, . . . , DL2M, . . . , DLN1, . . . , and DLNM in response to the clock signal of the data driver 130. In some embodiments, as illustrated in FIG. 1, the number of the plurality of channels SC11, . . . , SC1M, SC21, . . . , SC2M, . . . , SCN1, . . . , and SCNM may be substantially the same as the number of the plurality of data lines DL11, . . . , DL1M, DL21, . . . , DL2M, . . . , DLN1, . . . , and DLNM. In other embodiments, the number of the plurality of channels SC11, . . . , SC1M, SC21, . . . , SC2M, . . . , SCN1, . . . , and SCNM may be different from the number of the plurality of data lines DL11, . . . , DL1M, DL21, . . . , DL2M, . . . , DLN1, . . . , and DLNM. For example, a ratio of the number of the plurality of channels SC11, . . . , SC1M, SC21, . . . , SC2M, . . . , SCN1, . . . , and SCNM and the number of the plurality of data lines DL11, . . . , DL1M, DL21, . . . , DL2M, . . . , DLN1, . . . , and DLNM may be 1:2, 1:3, etc.

The controller 140, e.g., a timing controller (TCON), may receive input image data IDAT and a control signal CTRL from an external host processor, e.g., an application processor (AP), a graphic processing unit (GPU) or a graphic card. In some embodiments, the input image data IDAT may be RGB image data including red image data, green image data and blue image data. In some embodiments, the control signal CTRL may include a vertical synchronization signal, a horizontal synchronization signal, a data enable signal, a master clock signal, or the like. The controller 140 may control an operation of the scan driver 120 by providing the scan control signal SCTRL to the scan driver 120, and may control an operation of the data driver 130 by providing the output image data ODAT to the data driver 130.

In general, a frame period of the display device 100 may include an active period in which the data voltages are provided to the plurality of pixels PX of the display region DISPR, and a blank period (or a vertical blank period) in which the data voltages are not output to the plurality of data lines DL11, . . . , DL1M, DL21, . . . , DL2M, . . . , DLN1, . . . , and DLNM, or a black data voltage, e.g., a minimum data voltage corresponding to a minimum gray level such as a 0-gray level, is output to the plurality of data lines DL11, . . . , DL1M, DL21, . . . , DL2M, . . . , DLN1, . . . , and DLNM. A current, e.g., a current flowing through a line of the analog power supply voltage AVDD, in a conventional display device may be drastically changed (increased or decreased) between the blank period in which the data voltages are not output or the black data voltage is output and the active period in which the data voltages are output. Due to the drastic change of the current, components, e.g., a capacitor of the power management circuit, an inductor of the power management circuit, a control board on which the controller 140 is disposed, a source board on which the data driver 130 is disposed, etc., of the conventional display device may vibrate, and a sound noise may occur in the conventional display device by the vibration of the components.

However, in the display device 100 according to embodiments, to prevent the sound noise from occurring, the plurality of channels SC11, . . . , SC1M, SC21, . . . , SC2M, . . . , SCN1, . . . , and SCNM of the data driver 130 may be grouped into first through N-th channel groups SCG1, SCG2, . . . , and SCGN, where N is an integer greater than 1. The first through N-th channel groups SCG1, SCG2, . . . , and SCGN may sequentially initiate first dummy data voltage output operations in a first order from the first channel group SCG1 to the N-th channel group SCGN in a first blank period before an active period, may substantially simultaneously finish the first dummy data voltage output operations at an end time point of the first blank period, may substantially simultaneously initiate second dummy data voltage output operations at a start time point of a second blank period after the active period, and may sequentially finish the second dummy data voltage output operations in a second order from the N-th channel group SCGN to the first channel group SCG1 in the second blank period. Although FIG. 1 illustrates an example where each channel group, e.g., the first channel group SCG1, includes M channels, e.g., M channels SC11, . . . , and SC1M, where M is an integer greater than 0, the number of channels, e.g., channels SC11, . . . , and SC1M, of each channel group, e.g., the first channel group SCG1, may be any integer greater than 0. Further, in some embodiments, any two channel groups, e.g., channel groups SCG1 and SCG2, may have the same number of channels. In other embodiments, any two channel groups, e.g., channel groups SCG1 and SCG2, may have different numbers of channels.

For example, as illustrated in FIG. 3, each frame period FP of the display device 100 may include an active period AP and a blank period BP2. In the active period AP, the first through N-th channel groups SCG1, SCG2, . . . , and SCGN may substantially simultaneously perform active data voltage output operations AOP that provide the data voltages (or active data voltages corresponding to the output image data ODAT) to the plurality of pixels PX in the display region DISPR through the plurality of data lines DL11, . . . , DL1M, DL21, . . . , DL2M, . . . , DLN1, . . . , and DLNM. In the active period AP, the plurality of pixels PX in the display region DISPR may display an image based on the data voltages.

In some embodiments, as illustrated in FIG. 3, each blank period BP1 and BP2 may include a second dummy region period DUMP2 allocated to the second dummy region DUMR2 located at the lower side of the display region DISPR, a clock training period CKTP in which a clock training operation is performed, and a first dummy region period DUMP1 allocated to the first dummy region DUMR1 located at the upper side of the display region DISPR. In the clock training period CKTP, the controller 140 may transfer the clock training pattern data to the data driver 130, and may inform the data driver 130 about the transfer of the clock training pattern data by changing the shared forward channel SFC to a low level. The data driver 130 may perform training on the clock signal based on the clock training pattern data.

In the first dummy region period DUMP1 of the first blank period BP1 before the active period AP, the first through N-th channel groups SCG1, SCG2, . . . , and SCGN may perform a first dummy data voltage output operations DOP1 that provide dummy data voltages to the dummy pixels DPX in the first dummy region DUMR1 through the plurality of data lines DL11, . . . , DL1M, DL21, . . . , DL2M, . . . , DLN1, . . . , and DLNM. In particular, in the first dummy region period DUMP1 of the first blank period BP1 before the active period AP, the first through N-th channel groups SCG1, SCG2, . . . , and SCGN may sequentially initiate the first dummy data voltage output operations DOP1 in the first order from the first channel group SCG1 to the N-th channel group SCGN. For example, in the first dummy region period DUMP1, as illustrated in FIG. 3, the first channel group SCG1 may initiate the first dummy data voltage output operation DOP1 that outputs the dummy data voltages to the data lines DL11, . . . , DL1M, and then the second channel group SCG2 may initiate the first dummy data voltage output operation DOP1 that outputs the dummy data voltages to the data lines DL21, . . . , DL2M. In this manner, the N-th channel group SCGN may lastly initiate the first dummy data voltage output operation DOP1 that outputs the dummy data voltages to the data lines DLN1, . . . , DLNM. Further, the first through N-th channel groups SCG1, SCG2, . . . , and SCGN may substantially simultaneously finish the first dummy data voltage output operations DOP1 at an end time point of the first blank period BP1 or an end time point of the first dummy region period DUMP1. Since the first through N-th channel groups SCG1, SCG2, . . . , and SCGN may sequentially initiate the first dummy data voltage output operations DOP1 in the first order in the first dummy region period DUMP1, the current, e.g., the current flowing through the line of the analog power supply voltage AVDD, in the display device 100 may be gradually increased in the first dummy region period DUMP1. Accordingly, the sound noise caused by the drastic change of the current may be prevented from occurring. Further, since the first through N-th channel groups SCG1, SCG2, . . . , and SCGN are sequentially driven in the first dummy region period DUMP1, power consumption may be reduced compared with a case where all of the plurality of channels SC11, . . . , SC1M, SC21, . . . , SC2M, . . . , SCN1, . . . , and SCNM is simultaneously driven in each blank period BP1 and BP2.

Further, in the second dummy region period DUMP2 of the second blank period BP2 after the active period AP, the first through N-th channel groups SCG1, SCG2, . . . , and SCGN may perform the second dummy data voltage output operations DOP2 that provide the dummy data voltages to the dummy pixels DPX in the second dummy region DUMR2 through the plurality of data lines DL11, . . . , DL1M, DL21, . . . , DL2M, . . . , DLN1, . . . , and DLNM. The first through N-th channel groups SCG1, SCG2, . . . , and SCGN may substantially simultaneously initiate the second dummy data voltage output operations DOP2 at a start time point of the second blank period BP2 or a start time point of the second dummy region period DUMP2. In particular, in the second dummy region period DUMP2 of the second blank period BP2 after the active period AP, the first through N-th channel groups SCG1, SCG2, . . . , and SCGN may sequentially finish the second dummy data voltage output operations DOP2 in the second order from the N-th channel group SCGN to the first channel group SCG1. For example, in the second dummy region period DUMP2, as illustrated in FIG. 3, the N-th channel group SCGN may first finish the second dummy data voltage output operation DOP2 that outputs the dummy data voltages to the data lines DLN1, . . . , DLNM, and then the next channel group, or an (N−1)-th channel group may finish the second dummy data voltage output operation DOP2. In this manner, the second channel group SCG2 may finish the second dummy data voltage output operation DOP2 that outputs the dummy data voltages to the data lines DL21, . . . , DL2M, and then the first channel group SCG1 may lastly finish the second dummy data voltage output operation DOP2 that outputs the dummy data voltages to the data lines DL11, . . . , DL1M. Since the first through N-th channel groups SCG1, SCG2, . . . , and SCGN may sequentially finish the second dummy data voltage output operations DOP2 in the second order in the second dummy region period DUMP2, the current, e.g., the current flowing through the line of the analog power supply voltage AVDD, in the display device 100 may be gradually decreased in the second dummy region period DUMP2. Accordingly, the sound noise caused by the drastic change of the current may be prevented from occurring. Further, since driving of the first through N-th channel groups SCG1, SCG2, . . . , and SCGN is sequentially finished in the second dummy region period DUMP2, the power consumption may be reduced compared with the case where all of the plurality of channels SC11, . . . , SC1M, SC21, . . . , SC2M, . . . , SCN1, . . . , and SCNM is simultaneously driven in each blank period BP1 and BP2.

To sequentially initiate the first dummy data voltage output operations DOP1 in the first order in the first blank period BP1 before the active period AP, and to sequentially finish the second dummy data voltage output operations DOP2 in the second order in the second blank period BP2 after the active period AP, the data driver 130 may be controlled by the controller 140, or the clock signal of the data driver 130 may be used.

Figure 7:
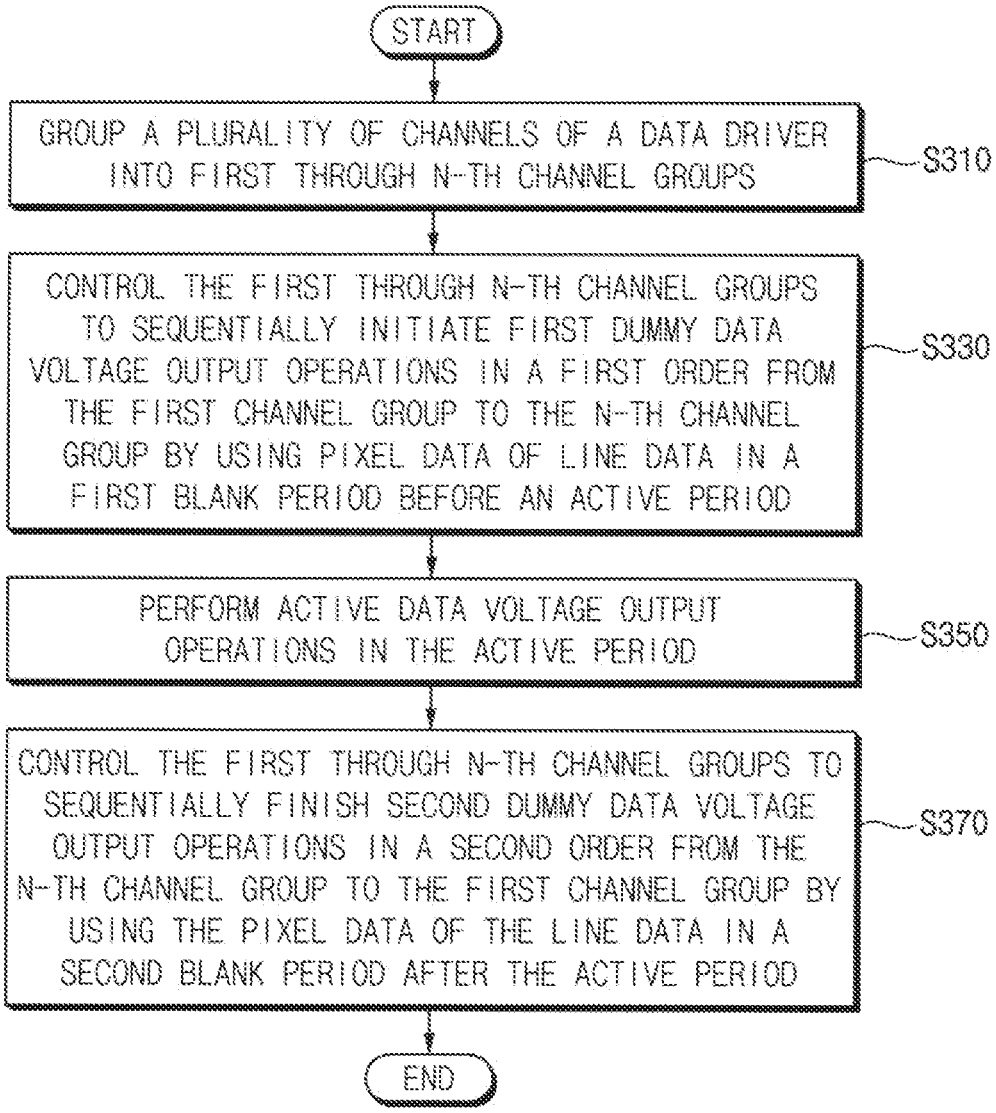
FIG. 7 is a flow chart illustrating a method of operating a display device according to embodiments.
Figure 8:
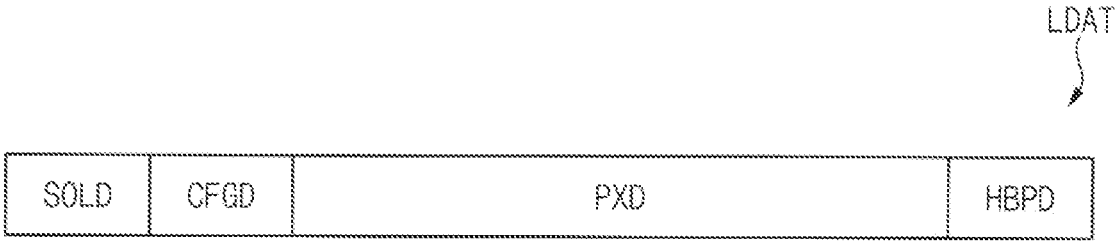
FIG. 8 is a diagram illustrating an example of line data provided from a controller to a data driver.
Figure 9:
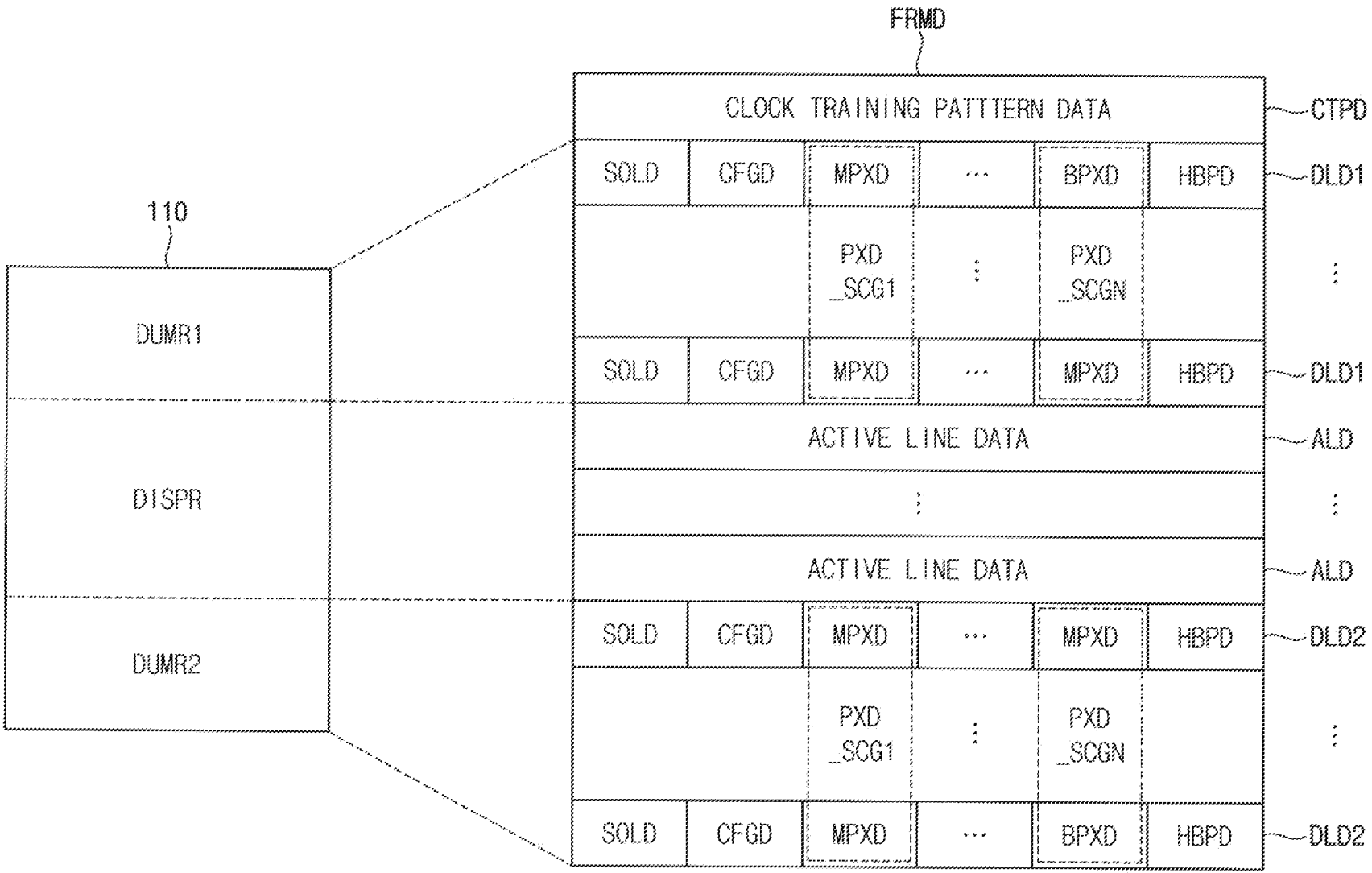
FIG. 9 is a diagram for describing an example of frame data including line data for controlling first through N-th channel groups to perform first and second dummy data voltage output operations.

In some embodiments, as illustrated in FIGS. 7 through 9, the controller 140 may control the first dummy data voltage output operations DOP1 of the first through N-th channel groups SCG1, SCG2, . . . , and SCGN by using pixel data included in the line data LDAT in the first blank period BP1, and may control the second dummy data voltage output operations DOP2 of the first through N-th channel groups SCG1, SCG2, . . . , and SCGN by using pixel data included in the line data LDAT in the second blank period BP2.

Figure 10:
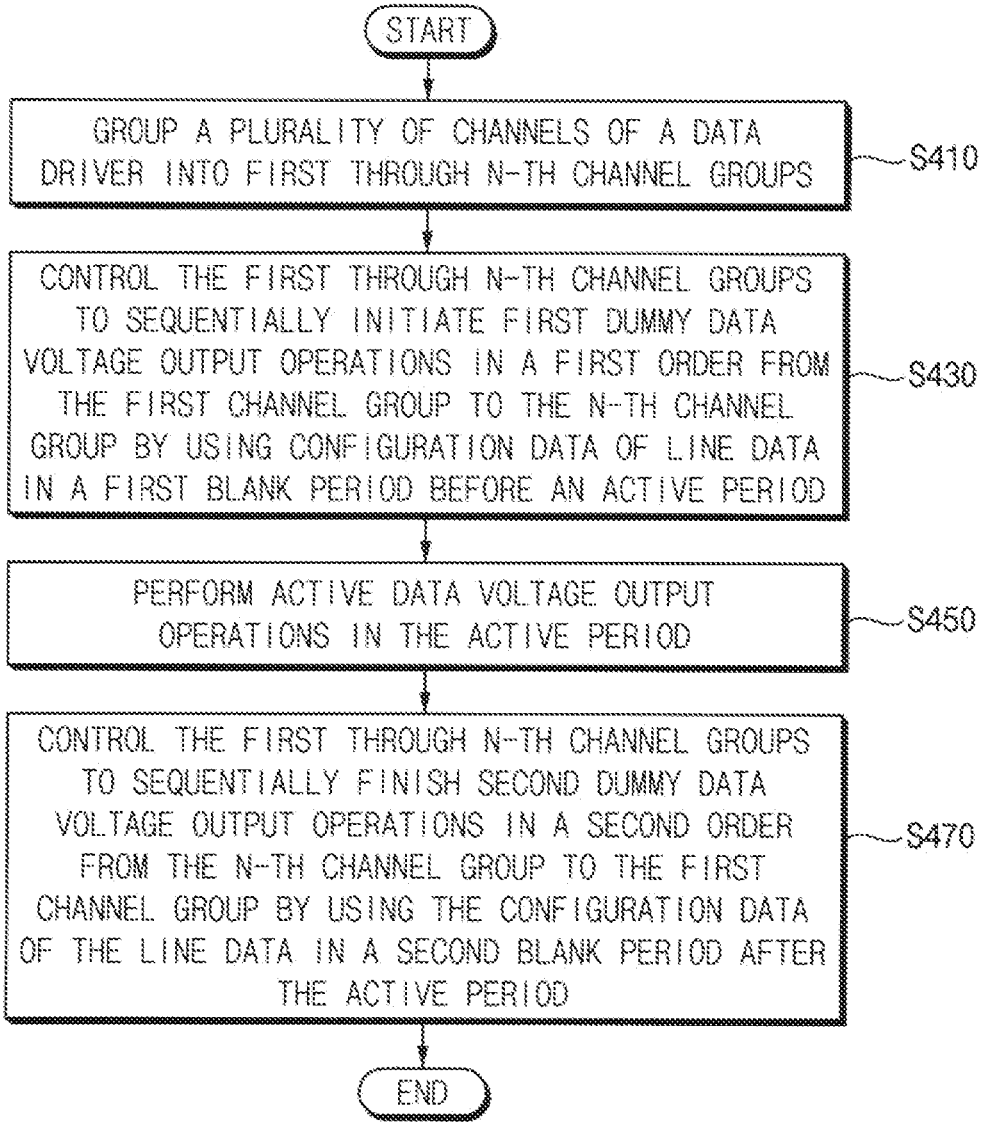
FIG. 10 is a flow chart illustrating a method of operating a display device according to embodiments.
Figure 11:
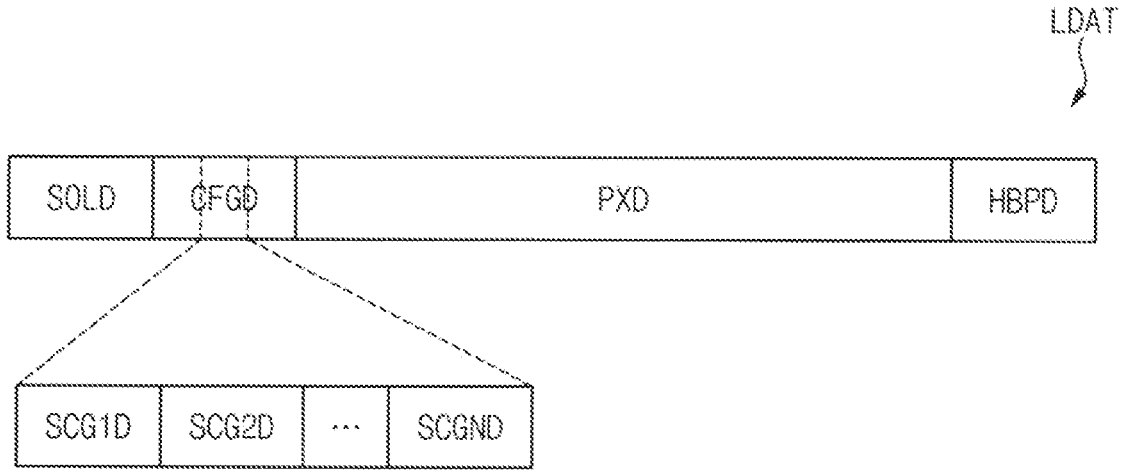
FIG. 11 is a diagram illustrating an example of line data for controlling first through N-th channel groups to perform first and second dummy data voltage output operations.

In other embodiments, as illustrated in FIGS. 10 and 11, the controller 140 may control the first dummy data voltage output operations DOP1 of the first through N-th channel groups SCG1, SCG2, . . . , and SCGN by using configuration data included in the line data LDAT in the first blank period BP1, and may control the second dummy data voltage output operations DOP2 of the first through N-th channel groups SCG1, SCG2, . . . , and SCGN by using configuration data included in the line data LDAT in the second blank period BP2.

Figure 12:
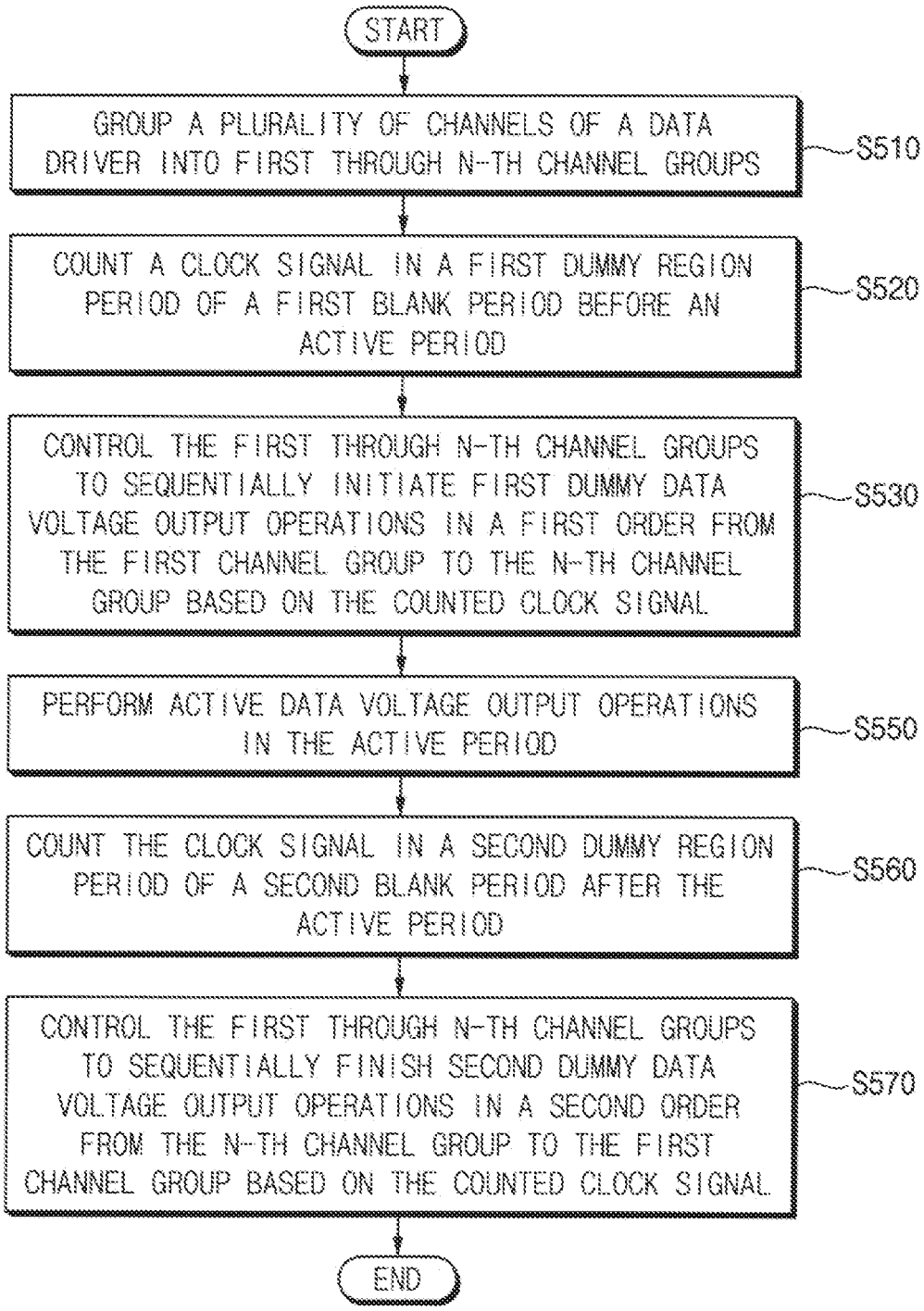
FIG. 12 is a flow chart illustrating a method of operating a display device according to embodiments.
Figure 13:
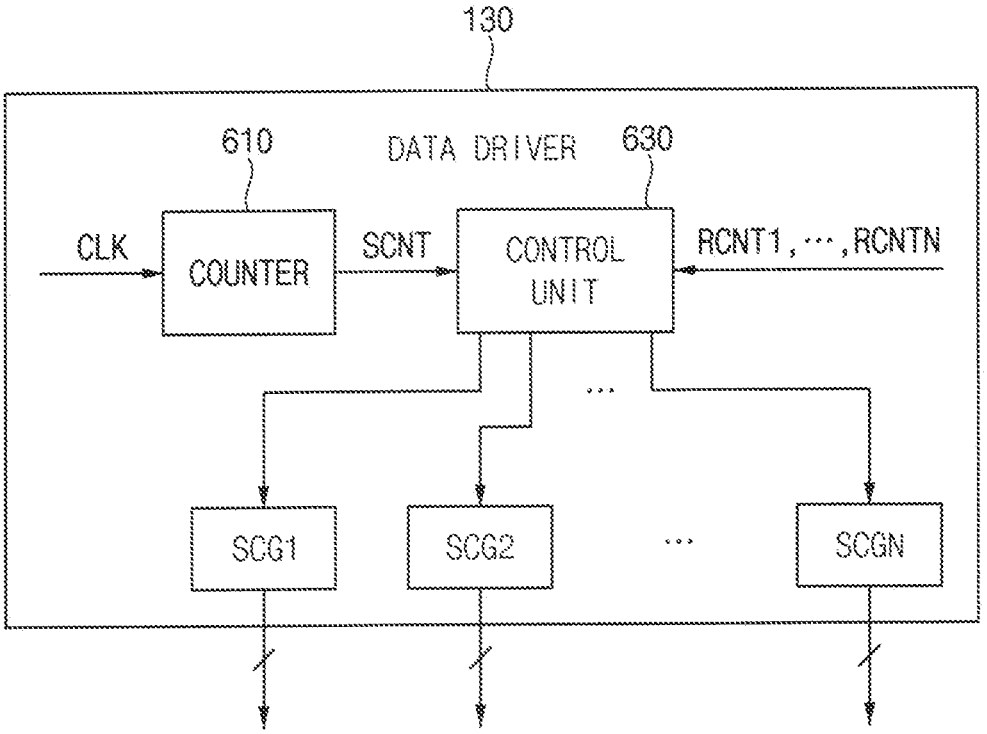
FIG. 13 is a block diagram illustrating an example of a data driver including a counter that counts a clock signal.

In still other embodiments, as illustrated in FIGS. 12 and 13, the data driver 130 may include a counter that counts the clock signal. The first dummy data voltage output operations DOP1 of the first through N-th channel groups SCG1, SCG2, . . . , and SCGN in the first blank period BP1 and the second dummy data voltage output operations DOP2 of the first through N-th channel groups SCG1, SCG2, . . . , and SCGN in the second blank period BP2 may be controlled based on the counted clock signal.

As described above, in the display device 100 according to embodiments, the plurality of channels SC11, . . . , SC1M, SC21, . . . , SC2M, . . . , SCN1, . . . , and SCNM of the data driver 130 may be grouped into the first through N-th channel groups SCG1, SCG2, . . . , and SCGN. The first dummy data voltage output operations DOP1 of the first through N-th channel groups SCG1, SCG2, . . . , and SCGN may be sequentially initiated in the first order from the first channel group SCG1 to the N-th channel group SCGN in the first blank period BP1 before the active period AP. The second dummy data voltage output operations DOP2 of the first through N-th channel groups SCG1, SCG2, . . . , and SCGN may be sequentially finished in the second order from the N-th channel group SCGN to the first channel group SCG1 in the second blank period BP2 after the active period AP. Thus, the current in the display device 100 may gradually increase in the first blank period BP1 before the active period AP, and may gradually decrease in the second blank period BP2 after the active period AP. Accordingly, the sound noise caused by the drastic change of the current may be prevented from occurring. Further, since the first through N-th channel groups may be sequentially driven in each blank period BP1 and BP2, the power consumption may be reduced compared with the case where all of the plurality of channels SC11, . . . , SC1M, SC21, . . . , SC2M, . . . , SCN1, . . . , and SCNM is simultaneously driven in each blank period BP1 and BP2.

Figure 4:
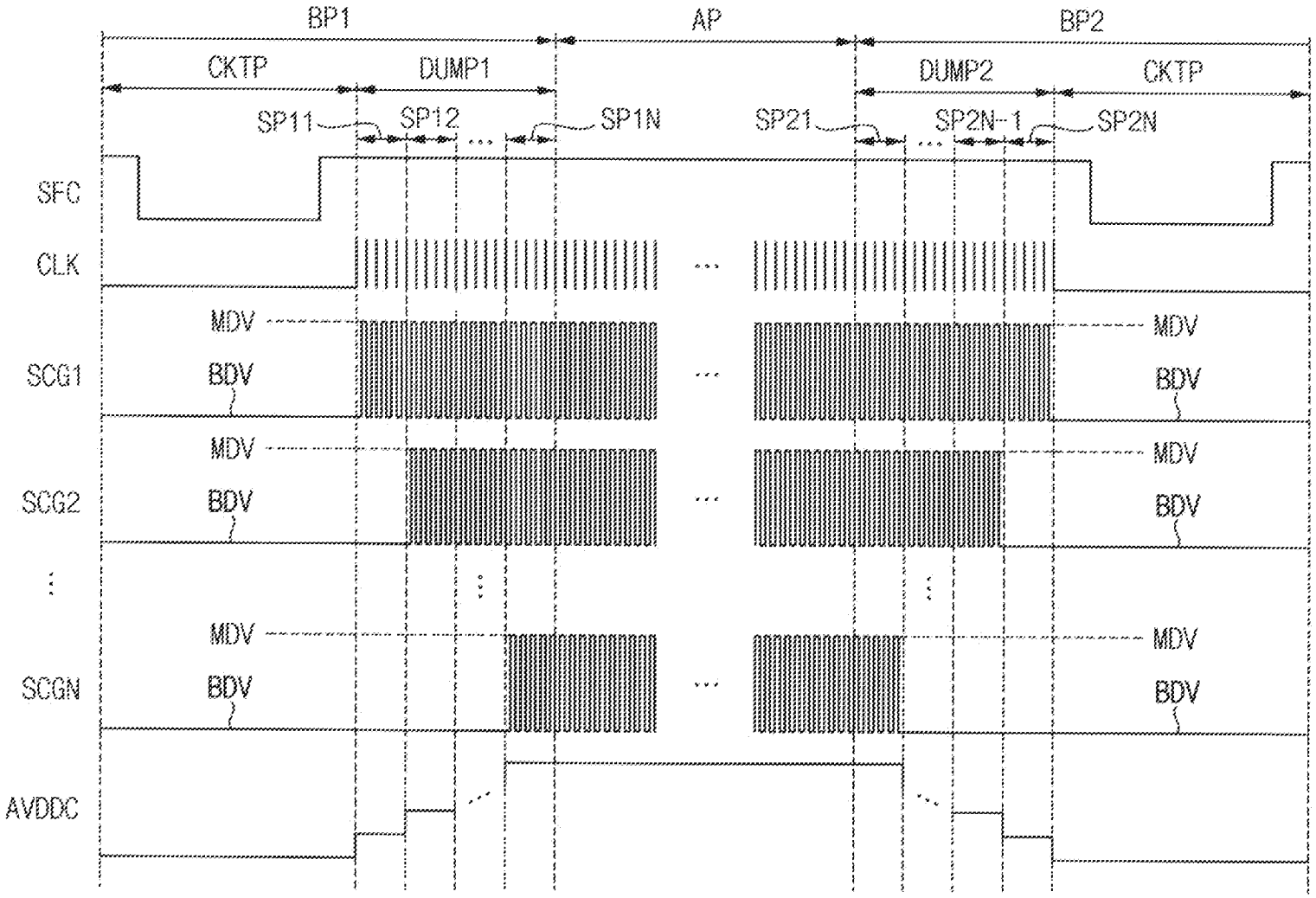
FIG. 4 is a timing diagram for describing an example of first and second dummy data voltage output operations of first through N-th channel groups of a data driver of a display device according to embodiments.

FIG. 4 is a timing diagram for describing an example of first and second dummy data voltage output operations of first through N-th channel groups of a data driver of a display device according to embodiments.

Referring to FIGS. 1 and 4, in the display device 100 according to embodiments, a plurality of channels SC11, . . . , SC1M, SC21, . . . , SC2M, . . . , SCN1, . . . , and SCNM of a data driver 130 may be grouped into first through N-th channel groups SCG1, SCG2, . . . , and SCGN. The first through N-th channel groups SCG1, SCG2, . . . , and SCGN may sequentially initiate first dummy data voltage output operations that output dummy data voltages to a plurality of data lines DL11, . . . , DL1M, DL21, . . . , DL2M, . . . , DLN1, . . . , and DLNM in a first order from the first channel group SCG1 to the N-th channel group SCGN in a first dummy region period DUMP1 of a first blank period BP1 before an active period AP. The first through N-th channel groups SCG1, SCG2, . . . , and SCGN may substantially simultaneously finish the first dummy data voltage output operations at an end time point of the first dummy region period DUMP1. The first through N-th channel groups SCG1, SCG2, . . . , and SCGN may substantially simultaneously initiate second dummy data voltage output operations that output the dummy data voltages to the plurality of data lines DL11, . . . , DL1M, DL21, . . . , DL2M, . . . , DLN1, . . . , and DLNM at a start time point of a second dummy region period DUMP2 of a second blank period BP2 after the active period AP. The first through N-th channel groups SCG1, SCG2, . . . , and SCGN may sequentially finish the second dummy data voltage output operations in a second order from the N-th channel group SCGN to the first channel group SCG1 in the second dummy region period DUMP2. In FIG. 4, a shared forward channel SFC may represent a shared forward channel for informing the data driver 130 about a transfer of clock training pattern data, and a clock signal CLK may represent a clock signal of the data driver 130. The plurality of channels SC11, . . . , SC1M, SC21, . . . , SC2M, . . . , SCN1, . . . , and SCNM of the data driver 130 may output the dummy data voltages or active data voltages for one pixel row to the plurality of data lines DL11, . . . , DL1M, DL21, . . . , DL2M, . . . , DLN1, . . . , and DLNM in response to each pulse of the clock signal CLK.

In some embodiments, as illustrated in FIG. 4, the first dummy region period DUMP1 of the first blank period BP1 before the active period AP may be, e.g., equally, divided into first through N-th sub-periods SP11, SP12, . . . , and SPIN. The first through N-th channel groups SCG1, SCG2, . . . , and SCGN may initiate the first dummy data voltage output operations at start time points of the first through N-th sub-periods SP11, SP12, . . . , and SPIN of the first dummy region period DUMP1, respectively. That is, the first channel group SCG1 may first initiate the first dummy data voltage output operation at the start time point of the first sub-period SP11 of the first dummy region period DUMP1. The second channel group SCG2 may initiate the first dummy data voltage output operation at the start time point of the second sub-period SP12 of the first dummy region period DUMP1. The N-th channel group SCGN may lastly initiate the first dummy data voltage output operation at the start time point of the N-th sub-period SPIN of the first dummy region period DUMP1. Further, as illustrated in FIG. 4, the first dummy data voltage output operations may be operations that alternately output maximum data voltages MDV and black data voltages BDV as the dummy data voltages to dummy pixels disposed in a first dummy region located at an upper side of a display region of a display panel 110. For example, the maximum data voltage MDV may be a data voltage corresponding to a maximum gray level, e.g., a 255-gray level, and the black data voltage BDV may be a data voltage corresponding to a minimum gray level, e.g., a 0-gray level. Since the first through N-th channel groups SCG1, SCG2, . . . , and SCGN may sequentially initiate the first dummy data voltage output operations in the first order in the first dummy region period DUMP1, a current AVDDC flowing through a line of an analog power supply voltage AVDD may be gradually increased as illustrated in FIG. 4. Accordingly, a sound noise caused by a drastic increase of the current AVDDC may be prevented from occurring. Further, since the first through N-th channel groups SCG1, SCG2, . . . , and SCGN are sequentially driven in the first dummy region period DUMP1, power consumption may be reduced compared with a case where all of the plurality of channels SC11, . . . , SC1M, SC21, . . . , SC2M, . . . , SCN1, . . . , and SCNM is simultaneously driven in each blank period BP1 and BP2.

Further, as illustrated in FIG. 4, the second dummy region period DUMP2 of the second blank period BP2 after the active period AP may be, e.g., equally, divided into first through N-th sub-periods SP21, . . . , SP2N−1, and SP2N. The first through N-th channel groups SCG1, SCG2, . . . , and SCGN may finish the second dummy data voltage output operations at end time points of the first through N-th sub-periods SP21, . . . , SP2N−1, and SP2N of the second dummy region period DUMP2, respectively. That is, the N-th channel group SCGN may first finish the second dummy data voltage output operation at the end time point of the first sub-period SP21 of the second dummy region period DUMP2, the second channel group SCG2 may finish the second dummy data voltage output operation at the end time point of the (N−1)-th sub-period SP2N−1 of the second dummy region period DUMP2, and the first channel group SCG1 may lastly finish the second dummy data voltage output operation at the end time point of the N-th sub-period SP2N of the second dummy region period DUMP2. Further, as illustrated in FIG. 4, the second dummy data voltage output operations may be operations that alternately output the maximum data voltages MDV and the black data voltages BDV as the dummy data voltages to dummy pixels disposed in a second dummy region located at a lower side of the display region of the display panel 110. Since the first through N-th channel groups SCG1, SCG2, . . . , and SCGN may sequentially finish the second dummy data voltage output operations in the second order in the second dummy region period DUMP2, the current AVDDC flowing through the line of the analog power supply voltage AVDD may be gradually decreased as illustrated in FIG. 4. Accordingly, the sound noise caused by a drastic decrease of the current AVDDC may be prevented from occurring. Further, since driving of the first through N-th channel groups SCG1, SCG2, . . . , and SCGN is sequentially finished in the second dummy region period DUMP2, the power consumption may be reduced compared with the case where all of the plurality of channels SC11, . . . , SC1M, SC21, . . . , SC2M, . . . , SCN1, . . . , and SCNM is simultaneously driven in each blank period BP1 and BP2.

Figure 5:
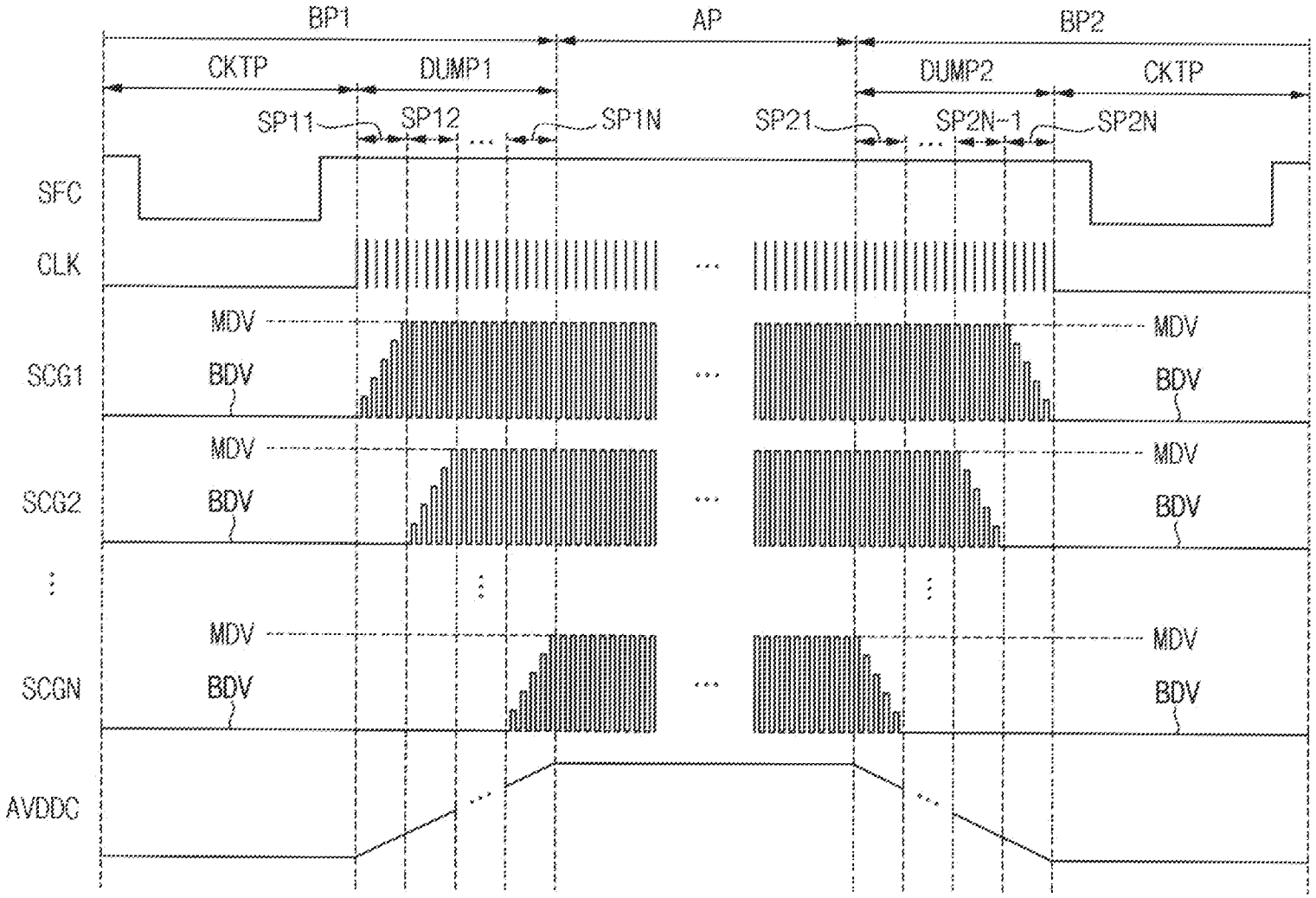
FIG. 5 is a timing diagram for describing another example of first and second dummy data voltage output operations of first through N-th channel groups of a data driver of a display device according to embodiments.

FIG. 5 is a timing diagram for describing another example of first and second dummy data voltage output operations of first through N-th channel groups of a data driver of a display device according to embodiments.

Operations of first through N-th channel groups SCG1, SCG2, . . . , and SCGN illustrated in FIG. 5 may be similar to operations of the first through N-th channel groups SCG1, SCG2, . . . , and SCGN illustrated in FIG. 4, except that dummy data voltages output by first dummy data voltage output operations in a first dummy region period DUMP1 may include gradually increasing data voltages, and dummy data voltages output by second dummy data voltage output operations in a second dummy region period DUMP2 may include gradually decreasing data voltages.

Referring to FIGS. 1 and 5, the first dummy data voltage output operations in the first dummy region period DUMP1 may be operations that alternately output the gradually increasing data voltages and black data voltages BDV as the dummy data voltages to dummy pixels disposed in a first dummy region located at an upper side of a display region of a display panel 110. For example, as illustrated in FIG. 5, the gradually increasing data voltages output at the first channel group SCG1 may gradually increase from the black data voltage BDV to a maximum data voltage MDV in a first sub-period SP11 of the first dummy region period DUMP1, the gradually increasing data voltages output at the second channel group SCG2 may gradually increase from the black data voltage BDV to the maximum data voltage MDV in a second sub-period SP12 of the first dummy region period DUMP1, and the gradually increasing data voltages output at the N-th channel group SCGN may gradually increase from the black data voltage BDV to the maximum data voltage MDV in an N-th sub-period SPIN of the first dummy region period DUMP1. Accordingly, in the first dummy region period DUMP1, a current AVDDC flowing through a line of an analog power supply voltage AVDD may be gradually, e.g., linearly, increased.

Further, the second dummy data voltage output operations in the second dummy region period DUMP2 may be operations that alternately output the gradually decreasing data voltages and the black data voltages BDV as the dummy data voltages to dummy pixels disposed in a second dummy region located at a lower side of the display region of the display panel 110. For example, as illustrated in FIG. 5, the gradually decreasing data voltages output at the N-th channel group SCGN may gradually decrease from the maximum data voltage MDV to the black data voltage BDV in a first sub-period SP21 of the second dummy region period DUMP2, the gradually decreasing data voltages output at the second channel group SCG2 may gradually decrease from the maximum data voltage MDV to the black data voltage BDV in an (N−1)-th sub-period SP2N−1 of the second dummy region period DUMP2, and the gradually decreasing data voltages output at the first channel group SCG1 may gradually decrease from the maximum data voltage MDV to the black data voltage BDV in an N-th sub-period SP2N of the second dummy region period DUMP2. Accordingly, in the second dummy region period DUMP2, the current AVDDC flowing through the line of the analog power supply voltage AVDD may be gradually, e.g., linearly, decreased.

Figure 6:
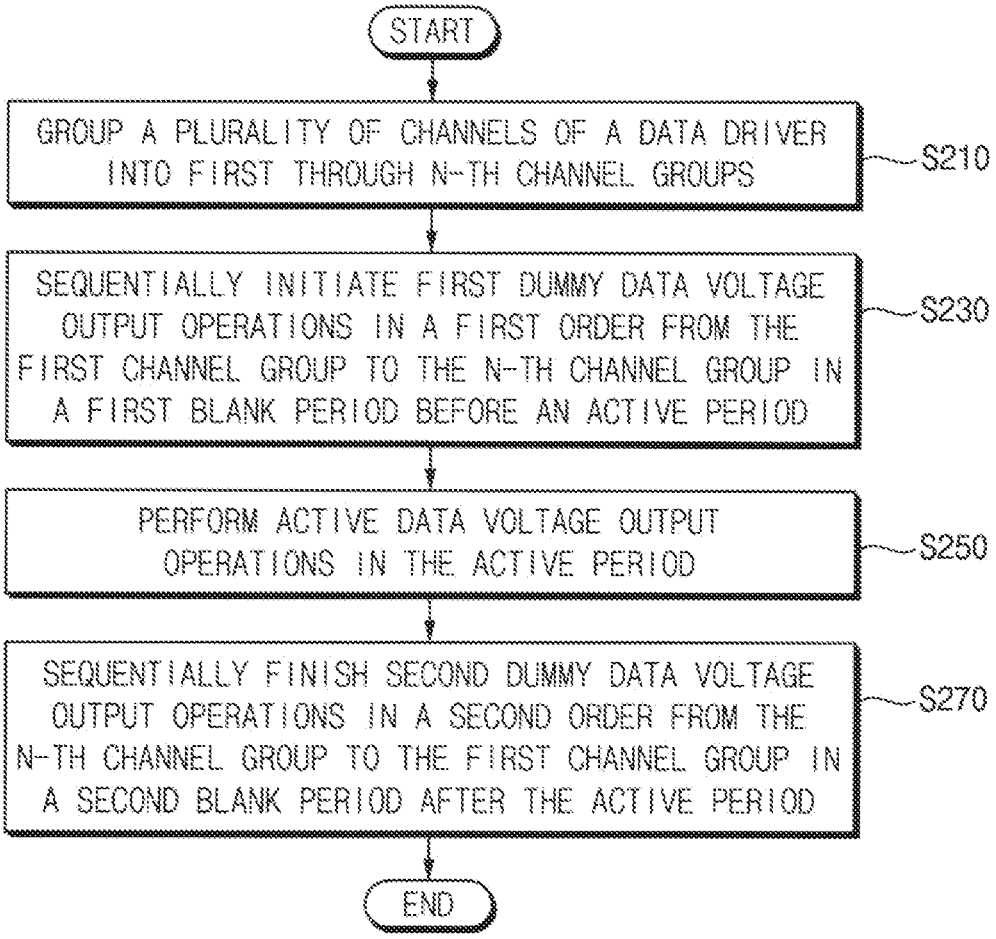
FIG. 6 is a flow chart illustrating a method of operating a display device according to embodiments.

FIG. 6 is a flow chart illustrating a method of operating a display device according to embodiments.

Referring to FIGS. 1 and 6, in a method of operating a display device 100 according to embodiments, a plurality of channels SC11, . . . , SC1M, SC21, . . . , SC2M, . . . , SCN1, . . . , and SCNM of a data driver 130 may be grouped into first through N-th channel groups SCG1, SCG2, . . . , and SCGN in an operation S210.

The first through N-th channel groups SCG1, SCG2, . . . , and SCGN may sequentially initiate first dummy data voltage output operations that output dummy data voltages to a plurality of data lines DL11, . . . , DL1M, DL21, . . . , DL2M, . . . , DLN1, . . . , and DLNM in a first order from the first channel group SCG1 to the N-th channel group SCGN in a first blank period before an active period in an operation S230. In some embodiments, the first blank period may include a first dummy region period in which the dummy data voltages are output to dummy pixels disposed in a first dummy region located at an upper side of a display region, and the first through N-th channel groups SCG1, SCG2, . . . , and SCGN may sequentially initiate the first dummy data voltage output operations in the first order in the first dummy region period. Further, the first through N-th channel groups SCG1, SCG2, . . . , and SCGN may substantially simultaneously finish the first dummy data voltage output operations at an end time point of the first blank period. Accordingly, in the first blank period, a current in the display device 100 may be gradually increased.

The first through N-th channel groups SCG1, SCG2, . . . , and SCGN may perform active data voltage output operations that provide data voltages to a plurality of pixels PX in the display region through the plurality of data lines DL11, . . . , DL1M, DL21, . . . , DL2M, . . . , DLN1, . . . , and DLNM in the active period in an operation S250. In the active period, the plurality of pixels PX may display an image based on the data voltages.

The first through N-th channel groups SCG1, SCG2, . . . , and SCGN may substantially simultaneously initiate second dummy data voltage output operations that outputs the dummy data voltages to the plurality of data lines DL11, . . . , DL1M, DL21, . . . , DL2M, . . . , DLN1, . . . , and DLNM at a start time point of a second blank period after the active period, and may sequentially finish the second dummy data voltage output operations in a second order from the N-th channel group SCGN to the first channel group SCG1 in the second blank period in an operation S270. In some embodiments, the second blank period may include a second dummy region period in which the dummy data voltages are output to dummy pixels disposed in a second dummy region located at a lower side of the display region, and the first through N-th channel groups SCG1, SCG2, . . . , and SCGN may sequentially finish the second dummy data voltage output operations in the second order in the second dummy region period. Accordingly, in the second blank period, the current in the display device 100 may be gradually decreased.

FIG. 7 is a flow chart illustrating a method of operating a display device according to embodiments. FIG. 8 is a diagram illustrating an example of line data provided from a controller to a data driver. FIG. 9 is a diagram for describing an example of frame data including line data for controlling first through N-th channel groups to perform first and second dummy data voltage output operations.

Referring to FIGS. 1 and 7, in a method of operating a display device 100 according to embodiments, a plurality of channels SC11, . . . , SC1M, SC21, . . . , SC2M, . . . , SCN1, . . . , and SCNM of a data driver 130 may be grouped into first through N-th channel groups SCG1, SCG2, . . . , and SCGN in an operation S310.

In a first blank period before an active period, to sequentially initiate first dummy data voltage output operations in a first order from the first channel group SCG1 to the N-th channel group SCGN, the first through N-th channel groups SCG1, SCG2, . . . , and SCGN may be controlled by pixel data of line data LDAT in an operation S330. In some embodiments, as illustrated in FIG. 8, the line data LDAT for each pixel row may include line start data SOLD representing a start of the line data LDAT, configuration data CFGD representing configuration information, pixel data PXD for a plurality of pixels PX (or dummy pixels) included in the pixel row, and horizontal blank period data HBPD corresponding to a horizontal blank period. The first dummy data voltage output operations of the first through N-th channel groups SCG1, SCG2, . . . , and SCGN may be controlled by the pixel data PXD of the line data LDAT.

FIG. 9 illustrates an example of frame data FRMD corresponding to one frame period as output image data ODAT transferred from a controller 140 to the data driver 130. The frame data FRMD may include clock training pattern data CTPD for a clock training operation, and a plurality of line data LDAT for pixel rows, e.g., rows of the dummy pixels and rows of the plurality of pixels PX, of a display panel 110. The plurality of line data LDAT of the frame data FRMD may include first dummy line data DLD1 for pixel rows (or the rows of the dummy pixels) of a first dummy region DUMR1 of the display panel 110, active line data ALD for pixel rows (or the rows of the plurality of pixels PX) of a display region DISPR of the display panel 110, and second dummy line data DLD2 for pixel rows (or the rows of the dummy pixels) of a second dummy region DUMR2 of the display panel 110.

In the first blank period before the active period, the controller 140 may use the pixel data PXD of the first dummy line data DLD1 for the first dummy region DUMR1 such that the first through N-th channel groups SCG1, SCG2, . . . , and SCGN may sequentially initiate the first dummy data voltage output operations in the first order from the first channel group SCG1 to the N-th channel group SCGN. For example, as illustrated in FIG. 9, with respect to a first pixel row of the first dummy region DUMR1, the controller 140 may transfer maximum pixel data MPXD representing a maximum gray level as pixel data PXD_SCG1 for the first channel group SCG1 to the data driver 130 such that the first channel group SCG1 may perform the first dummy data voltage output operation. Further, with respect to the first pixel row of the first dummy region DUMR1, the controller 140 may transfer black pixel data BPXD representing a minimum gray level or a black gray level as pixel data PXD_SCGN for the N-th channel group SCGN to the data driver 130 such that the N-th channel group SCGN may not perform the first dummy data voltage output operation. With respect to subsequent pixel rows of the first dummy region DUMR1, the number of the maximum pixel data MPXD included in the pixel data PXD of each first dummy line data DLD1 may be gradually increased, and the number of the black pixel data BPXD included in the pixel data PXD of each first dummy line data DLD1 may be gradually decreased. With respect to the last pixel row of the first dummy region DUMR1, the controller 140 may transfer the first dummy line data DLD1 including only the maximum pixel data MPXD to the data driver 130 such that all of the first through N-th channel groups SCG1, SCG2, . . . , and SCGN may perform the first dummy data voltage output operations. In response to the first dummy line data DLD1 for the pixel rows of the first dummy region DUMR1, the first through N-th channel groups SCG1, SCG2, . . . , and SCGN may sequentially initiate the first dummy data voltage output operations in the first order from the first channel group SCG1 to the N-th channel group SCGN in the first blank period.

In the active period, the first through N-th channel groups SCG1, SCG2, . . . , and SCGN may perform active data voltage output operations that provide data voltages to the plurality of pixels PX in the display region DISPR of the display panel 110 through a plurality of data lines DL11, . . . , DL1M, DL21, . . . , DL2M, . . . , DLN1, . . . , and DLNM in an operation S350.

In a second blank period after the active period, to sequentially finish second dummy data voltage output operations in a second order from the N-th channel group SCGN to the first channel group SCG1, the first through N-th channel groups SCG1, SCG2, . . . , and SCGN may be controlled by the pixel data PXD of the line data LDAT in an operation S370. In the second blank period after the active period, the controller 140 may use the pixel data PXD of the second dummy line data DLD2 for the second dummy region DUMR2 such that the first through N-th channel groups SCG1, SCG2, . . . , and SCGN may sequentially finish the second dummy data voltage output operations in the second order from the N-th channel group SCGN to the first channel group SCG1.

For example, as illustrated in FIG. 9, with respect to a first pixel row of the second dummy region DUMR2, the controller 140 may transfer the second dummy line data DLD2 including only the maximum pixel data MPXD to the data driver 130 such that all of the first through N-th channel groups SCG1, SCG2, . . . , and SCGN may perform the second dummy data voltage output operations. With respect to subsequent pixel rows of the second dummy region DUMR2, the number of the maximum pixel data MPXD included in each second dummy line data DLD2 may be gradually decreased, and the number of the black pixel data BPXD included in each second dummy line data DLD2 may be gradually increased. With respect to the last pixel row of the second dummy region DUMR2, the controller 140 may transfer the maximum pixel data MPXD as the pixel data PXD_SCG1 for the first channel group SCG1 to the data driver 130 such that the first channel group SCG1 may perform the second dummy data voltage output operation, and may transfer the black pixel data BPXD as the pixel data PXD_SCGN for the N-th channel group SCGN to the data driver 130 such that the N-th channel group SCGN may not perform the second dummy data voltage output operation. In response to the second dummy line data DLD2 for the pixel rows of the second dummy region DUMR2, the first through N-th channel groups SCG1, SCG2, . . . , and SCGN may sequentially finish the second dummy data voltage output operations in the second order from the N-th channel group SCGN to the first channel group SCG1 in the second blank period.

FIG. 10 is a flow chart illustrating a method of operating a display device according to embodiments. FIG. 11 is a diagram illustrating an example of line data LDAT for controlling first through N-th channel groups to perform first and second dummy data voltage output operations.

Referring to FIGS. 1 and 10, in a method of operating a display device 100 according to embodiments, a plurality of channels SC11, . . . , SC1M, SC21, . . . , SC2M, . . . , SCN1, . . . , and SCNM of a data driver 130 may be grouped into first through N-th channel groups SCG1, SCG2, . . . , and SCGN in an operation S410.

In a first blank period before an active period, to sequentially initiate first dummy data voltage output operations in a first order from the first channel group SCG1 to the N-th channel group SCGN, the first through N-th channel groups SCG1, SCG2, . . . , and SCGN may be controlled by configuration data of line data LDAT in an operation S430. In some embodiments, as illustrated in FIG. 11, the configuration data CFGD of the line data LDAT in the first blank period may include first through N-th channel group operation data SCG1D, SCG2D, . . . , and SCGND representing whether the first dummy data voltage output operations of the first through N-th channel groups SCG1, SCG2, . . . , and SCGN are to be performed. In response to the first through N-th channel group operation data SCG1D, SCG2D, . . . , and SCGND, the first through N-th channel groups SCG1, SCG2, . . . , and SCGN may sequentially initiate the first dummy data voltage output operations in the first order from the first channel group SCG1 to the N-th channel group SCGN in the first blank period.

In the active period, the first through N-th channel groups SCG1, SCG2, . . . , and SCGN may perform active data voltage output operations that provide data voltages to a plurality of pixels PX in a display region of a display panel 110 through a plurality of data lines DL11, . . . , DL1M, DL21, . . . , DL2M, . . . , DLN1, . . . , and DLNM in an operation S450.

In a second blank period after the active period, to sequentially finish second dummy data voltage output operations in a second order from the N-th channel group SCGN to the first channel group SCG1, the first through N-th channel groups SCG1, SCG2, . . . , and SCGN may be controlled by the configuration data CFGD of the line data LDAT in an operation S470. In some embodiments, as illustrated in FIG. 11, the configuration data CFGD of the line data LDAT in the second blank period may include the first through N-th channel group operation data SCG1D, SCG2D, . . . , and SCGND, and the first through N-th channel groups SCG1, SCG2, . . . , and SCGN may sequentially finish the second dummy data voltage output operations in the second order from the N-th channel group SCGN to the first channel group SCG1 in response to the first through N-th channel group operation data SCG1D, SCG2D, . . . , and SCGND in the second blank period.

FIG. 12 is a flow chart illustrating a method of operating a display device according to embodiments. FIG. 13 is a block diagram illustrating an example of a data driver including a counter that counts a clock signal.

Referring to FIGS. 1 and 12, in a method of operating a display device 100 according to embodiments, a plurality of channels SC11, . . . , SC1M, SC21, . . . , SC2M, . . . , SCN1, . . . , and SCNM of a data driver 130 may be grouped into first through N-th channel groups SCG1, SCG2, . . . , and SCGN in an operation S510.

In a first dummy region period of a first blank period before an active period, a clock signal of the data driver 130 may be counted to generate a counted clock signal in an operation S520. The first through N-th channel groups SCG1, SCG2, . . . , and SCGN may be controlled based on the counted clock signal to sequentially initiate first dummy data voltage output operations in a first order from the first channel group SCG1 to the N-th channel group SCGN in an operation S530. To perform these operations, in some embodiments, as illustrated in FIG. 13, the data driver 130 may include a counter 610 that generates a count signal SCNT by counting the clock signal CLK, and a control unit 630 that controls the first through N-th channel groups SCG1, SCG2, . . . , and SCGN in response to the count signal SCNT. For example, to sequentially initiate the first dummy data voltage output operations of the first through N-th channel groups SCG1, SCG2, . . . , and SCGN, the control unit 630 may control the first channel group SCG1 to initiate the first dummy data voltage output operation when the count signal SCNT reaches a first reference count value RCNT1, and may control the N-th channel group SCGN to initiate the first dummy data voltage output operation when the count signal SCNT reaches an N-th reference count value RCNTN.

In the active period, the first through N-th channel groups SCG1, SCG2, . . . , and SCGN may perform active data voltage output operations that provide data voltages to a plurality of pixels PX in a display region of a display panel 110 through a plurality of data lines DL11, . . . , DL1M, DL21, . . . , DL2M, . . . , DLN1, . . . , and DLNM in an operation S550.

In a second dummy region period of a second blank period after the active period, the clock signal CLK of the data driver 130 may be counted in an operation S560, and the first through N-th channel groups SCG1, SCG2, . . . , and SCGN may be controlled based on the counted clock signal SCLK to sequentially finish second dummy data voltage output operations in a second order from the N-th channel group SCGN to the first channel group SCG1 in an operation S570. In an example of FIG. 13, to sequentially finish the second dummy data voltage output operations of the first through N-th channel groups SCG1, SCG2, . . . , and SCGN, the control unit 630 may control the N-th channel group SCGN to finish the second dummy data voltage output operation when the count signal SCNT reaches the first reference count value RCNT1, and may control the first channel group SCG1 to finish the second dummy data voltage output operation when the count signal SCNT reaches the N-th reference count value RCNTN.

Figure 14:
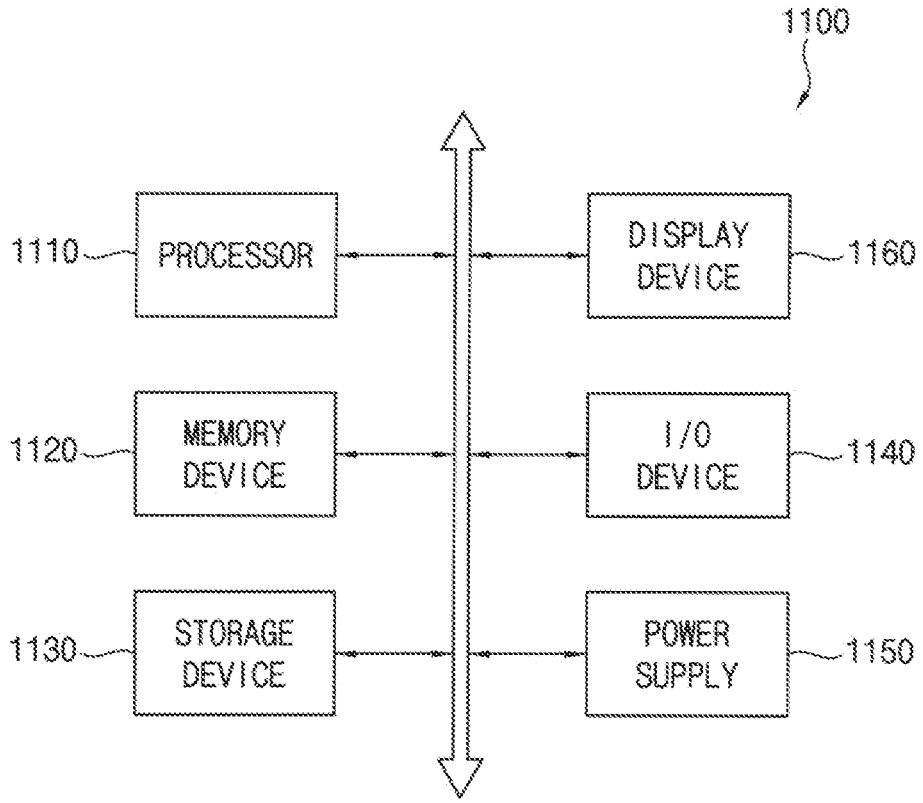
FIG. 14 is a block diagram illustrating an electronic device including a display device according to embodiments.

FIG. 14 is a block diagram illustrating an electronic device 1100 including a display device 1160 according to embodiments.

Referring to FIG. 14, the electronic device 1100 may include a processor 1110, a memory device 1120, a storage device 1130, an input/output (I/O) device 1140, a power supply 1150, and the display device 1160. The electronic device 1100 may further include a plurality of ports for communicating with a video card, a sound card, a memory card, a universal serial bus (USB) device, other electric devices, etc.

The processor 1110 may perform various computing functions or tasks. The processor 1110 may be an application processor (AP), a micro processor, a central processing unit (CPU), etc. The processor 1110 may be coupled to other components via an address bus, a control bus, a data bus, etc. Further, in some embodiments, the processor 1110 may be further coupled to an extended bus such as a peripheral component interconnection (PCI) bus.

The memory device 1120 may store data for operations of the electronic device 1100. For example, the memory device 1120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile dynamic random access memory (mobile DRAM) device, etc.

The storage device 1130 may be a solid state drive (SSD) device, a hard disk drive (HDD) device, a CD-ROM device, etc. The I/O device 1140 may be an input device such as a keyboard, a keypad, a mouse, a touch screen, etc, and an output device such as a printer, a speaker, etc. The power supply 1150 may supply power for operations of the electronic device 1100. The display device 1160 may be coupled to other components through the buses or other communication links.

In the display device 1160, a plurality of channels of a data driver may be grouped into first through N-th channel groups, first dummy data voltage output operations of the first through N-th channel groups may be sequentially initiated in a first order from the first channel group to the N-th channel group in a first blank period before an active period, and second dummy data voltage output operations of the first through N-th channel groups may be sequentially finished in a second order from the N-th channel group to the first channel group in a second blank period after the active period. Thus, a current in the display device 1160 may gradually increase in the first blank period before the active period, and may gradually decrease in the second blank period after the active period. Accordingly, a sound noise caused by a drastic change of the current may be prevented from occurring. Further, since the first through N-th channel groups may be sequentially driven in each blank period, power consumption may be reduced compared with a case where all of the plurality of channels is simultaneously driven.

The inventive concepts may be applied any electronic device 1100 including the display device 1160. For example, the inventive concepts may be applied to a television (TV), a digital TV, a 3D TV, a mobile phone, a smart phone, a tablet computer, a virtual reality (VR) device, a wearable electronic device, a personal computer (PC), a home appliance, a laptop computer, a personal digital assistant (PDA), a portable multimedia player (PMP), a digital camera, a music player, a portable game console, a navigation device, etc.

The foregoing is illustrative of embodiments and is not to be construed as limiting thereof. Although a few embodiments have been described, those skilled in the art will readily appreciate that many modifications are possible in the embodiments without materially departing from the novel teachings and features of the present inventive concept. Accordingly, all such modifications are intended to be included within the scope of the present inventive concept as defined in the claims. Therefore, it is to be understood that the foregoing is illustrative of various embodiments and is not to be construed as limited to the specific embodiments disclosed, and that modifications to the disclosed embodiments, as well as other embodiments, are intended to be included within the scope of the appended claims.

What is claimed is:

1. A display device comprising:

a display panel including a plurality of data lines, and a plurality of pixels coupled to the plurality of data lines;

a data driver including a plurality of channels providing data voltages to the plurality of pixels through the plurality of data lines; and a controller configured to control the data driver, wherein the plurality of channels is grouped into first through N-th channel groups, where N is an integer greater than 1, wherein the first through N-th channel groups sequentially initiate first dummy data voltage output operations in a first order from the first channel group to the N-th channel group in a first blank period before an active period, and wherein the first through N-th channel groups sequentially finish second dummy data voltage output operations in a second order from the N-th channel group to the first channel group in a second blank period after the active period.

2. The display device of claim 1, wherein the first through N-th channel groups substantially simultaneously finish the first dummy data voltage output operations at an end time point of the first blank period, and wherein the first through N-th channel groups substantially simultaneously initiate the second dummy data voltage output operations at a start time point of the second blank period.

3. The display device of claim 1, wherein the display panel further includes dummy pixels disposed in a first dummy region located at a first side of a display region in which the plurality of pixels is disposed, wherein the first blank period includes a first dummy region period in which dummy data voltages are output to the dummy pixels disposed in the first dummy region, and wherein the first through N-th channel groups sequentially initiate the first dummy data voltage output operations in the first order in the first dummy region period.

4. The display device of claim 3, wherein the first dummy region period is divided into first through N-th sub-periods, and wherein the first through N-th channel groups initiate the first dummy data voltage output operations at start time points of the first through N-th sub-periods, respectively.

5. The display device of claim 3, wherein the first dummy data voltage output operations alternately output maximum data voltages and black data voltages as the dummy data voltages to the dummy pixels.

6. The display device of claim 3, wherein the first dummy data voltage output operations alternately output gradually increasing data voltages and black data voltages as the dummy data voltages to the dummy pixels.

7. The display device of claim 1, wherein the display panel further includes dummy pixels disposed in a second dummy region located at a second side of a display region in which the plurality of pixels is disposed, wherein the second blank period includes a second dummy region period in which dummy data voltages are output to the dummy pixels disposed in the second dummy region, and wherein the first through N-th channel groups sequentially finish the second dummy data voltage output operations in the second order in the second dummy region period.

8. The display device of claim 7, wherein the second dummy region period is divided into first through N-th sub-periods, and wherein the first through N-th channel groups finish the second dummy data voltage output operations at end time points of the first through N-th sub-periods, respectively.

9. The display device of claim 7, wherein the second dummy data voltage output operations alternately output maximum data voltages and black data voltages as the dummy data voltages to the dummy pixels.

10. The display device of claim 7, wherein the second dummy data voltage output operations alternately output gradually decreasing data voltages and black data voltages as the dummy data voltages to the dummy pixels.

11. The display device of claim 1, wherein the controller provides line data for each pixel row to the data driver, wherein the line data includes line start data representing a start of the line data, configuration data representing configuration information, pixel data for the plurality of pixels included in the each pixel row, and horizontal blank period data corresponding to a horizontal blank period, wherein the first dummy data voltage output operations of the first through N-th channel groups in the first blank period are controlled by the pixel data of the line data in the first blank period, and wherein the second dummy data voltage output operations of the first through N-th channel groups in the second blank period are controlled by the pixel data of the line data in the second blank period.

12. The display device of claim 1, wherein the controller provides line data for each pixel row to the data driver, wherein the line data includes line start data representing a start of the line data, configuration data representing configuration information, pixel data for the plurality of pixels included in the each pixel row, and horizontal blank period data corresponding to a horizontal blank period, wherein the first dummy data voltage output operations of the first through N-th channel groups in the first blank period are controlled by the configuration data of the line data in the first blank period, and wherein the second dummy data voltage output operations of the first through N-th channel groups in the second blank period are controlled by the configuration data of the line data in the second blank period.

13. The display device of claim 1, wherein the data driver includes a counter that counts a clock signal to generate a counted clock signal, and wherein the first dummy data voltage output operations of the first through N-th channel groups in the first blank period and the second dummy data voltage output operations of the first through N-th channel groups in the second blank period are controlled based on the counted clock signal.

14. A method of operating a display device, the method comprising:

grouping a plurality of channels of a data driver of the display device into first through N-th channel groups, where N is an integer greater than 1;

sequentially initiating first dummy data voltage output operations of the first through N-th channel groups in a first order from the first channel group to the N-th channel group in a first blank period before an active period;

performing active data voltage output operations of the first through N-th channel groups in the active period; and sequentially finishing second dummy data voltage output operations of the first through N-th channel groups in a second order from the N-th channel group to the first channel group in a second blank period after the active period.

15. The method of claim 14, further comprising:

substantially simultaneously finishing the first dummy data voltage output operations of the first through N-th channel groups at an end time point of the first blank period; and substantially simultaneously initiating the second dummy data voltage output operations of the first through N-th channel groups at a start time point of the second blank period.

16. The method of claim 14, wherein a display panel of the display device includes a plurality of pixels disposed in a display region, and dummy pixels disposed in a first dummy region located at a first side of the display region, wherein the first blank period includes a first dummy region period in which dummy data voltages are output to the dummy pixels disposed in the first dummy region, and wherein the first through N-th channel groups sequentially initiate the first dummy data voltage output operations in the first order in the first dummy region period.

17. The method of claim 14, wherein a display panel of the display device includes a plurality of pixels disposed in a display region, and dummy pixels disposed in a second dummy region located at a second side of the display region, wherein the second blank period includes a second dummy region period in which dummy data voltages are output to the dummy pixels disposed in the second dummy region, and wherein the first through N-th channel groups sequentially finish the second dummy data voltage output operations in the second order in the second dummy region period.

18. The method of claim 14, wherein a controller of the display device provides line data for each pixel row to the data driver, wherein the line data includes configuration data representing configuration information, pixel data for the plurality of pixels included in the each pixel row, and horizontal blank period data corresponding to a horizontal blank period, wherein the first dummy data voltage output operations of the first through N-th channel groups in the first blank period are controlled by the pixel data of the line data in the first blank period, and wherein the second dummy data voltage output operations of the first through N-th channel groups in the second blank period are controlled by the pixel data of the line data in the second blank period.

19. The method of claim 14, wherein a controller of the display device provides line data for each pixel row to the data driver, wherein the line data includes line start data representing a start of the line data, configuration data representing configuration information, pixel data for the plurality of pixels included in the each pixel row, and horizontal blank period data corresponding to a horizontal blank period, wherein the first dummy data voltage output operations of the first through N-th channel groups in the first blank period are controlled by the configuration data of the line data in the first blank period, and wherein the second dummy data voltage output operations of the first through N-th channel groups in the second blank period are controlled by the configuration data of the line data in the second blank period.

20. The method of claim 14, wherein the data driver includes a counter that counts a clock signal to generate a counted clock signal, and wherein the first dummy data voltage output operations of the first through N-th channel groups in the first blank period and the second dummy data voltage output operations of the first through N-th channel groups in the second blank period are controlled based on the counted clock signal.

* * * * *